US007124908B2

(12) United States Patent
Sanders

(10) Patent No.: US 7,124,908 B2
(45) **Date of Patent: *Oct. 24, 2006**

(54) OVOID FLEXIBLE PRESSURE VESSEL, APPARATUS AND METHOD FOR MAKING SAME

(76) Inventor: Stan A. Sanders, 16510 Blenham Way, Chesterfield, MI (US) 63005

( * ) Notice: Subject to any disclaimer, the term of this patent is extended or adjusted under 35 U.S.C. 154(b) by 525 days.

This patent is subject to a terminal disclaimer.

(21) Appl. No.: 10/636,388

(22) Filed: Aug. 6, 2003

(65) Prior Publication Data

US 2004/0094557 A1 May 20, 2004

Related U.S. Application Data

(63) Continuation-in-part of application No. 10/295,488, filed on Nov. 14, 2002.

(51) Int. Cl.
*F17C 1/02* (2006.01)

(52) U.S. Cl. ..... 220/581; 220/366.1

(58) Field of Classification Search ..... None
See application file for complete search history.

(56) References Cited

U.S. PATENT DOCUMENTS

| | | | | |
|---|---|---|---|---|
| 3,750,907 | A | 8/1973 | Steele | |
| 3,802,594 | A | 4/1974 | Lemelson | |
| 3,959,058 | A | 5/1976 | Rath et al. | |
| 4,061,457 | A | 12/1977 | Butler | |
| 4,133,442 | A * | 1/1979 | Wiltshire et al. | 220/4.13 |
| 4,219,125 | A * | 8/1980 | Wiltshire et al. | 220/4.13 |
| 4,484,691 | A | 11/1984 | Lees | |
| 4,624,657 | A | 11/1986 | Gould et al. | |
| 4,650,452 | A | 3/1987 | Jensen | |
| 4,759,472 | A | 7/1988 | Strenger | |
| 4,954,678 | A | 9/1990 | Harmony et al. | |
| 5,072,851 | A * | 12/1991 | Wilkes | 220/203.12 |
| 5,093,546 | A | 3/1992 | Matsumiya et al. | |
| 5,160,396 | A | 11/1992 | Jensen et al. | |
| 5,333,763 | A | 8/1994 | Lane et al. | |
| 5,460,762 | A | 10/1995 | Andre | |
| 5,516,004 | A | 5/1996 | Lane | |
| 5,906,205 | A | 5/1999 | Hiebert | |
| 5,932,132 | A | 8/1999 | Plemons | |
| 6,134,970 | A | 10/2000 | Kumakawa et al. | |
| 6,161,624 | A | 12/2000 | Bennett | |
| 6,226,933 | B1 | 5/2001 | Nelson et al. | |

* cited by examiner

*Primary Examiner*—Stephen Castellano
(74) *Attorney, Agent, or Firm*—David A. Belasco; Belasco Jacobs & Townsley, LLP

(57) ABSTRACT

An ovoid flexible pressure vessel is described. At least one hollow pressure cell, formed of resilient material, a passageway, a valving means, a capillary tube, hoop winding, high-strength braiding material and at least one reinforcing ring are provided. The ovoid flexible pressure vessel has a pressure relief device comprising a reduction in thickness of the hollow pressure cell at a predetermined location whereby, when the hollow pressure cell is subjected to an overpressure condition it will fail at the predetermined location. Further pressure release devices include the following: a reduction in thickness of the cell, an indentation, a projecting member, a weakened section of the passageway, a weakening or an absence of high-strength braiding material or hoop winding at a predetermined location along the passageway, a weakening or spreading of fibers in either of the reinforcing panels or in either flexible blankets.

57 Claims, 27 Drawing Sheets

FIG. 11
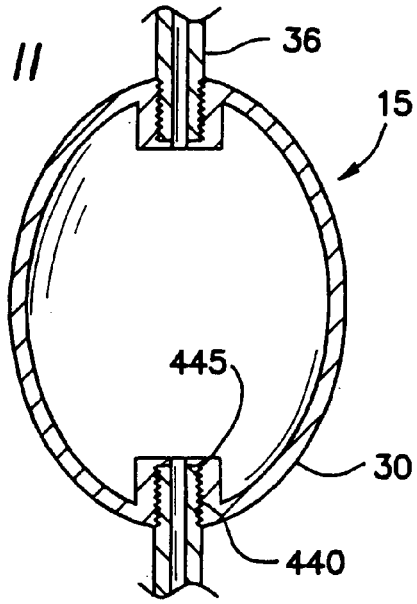
FIG. 12
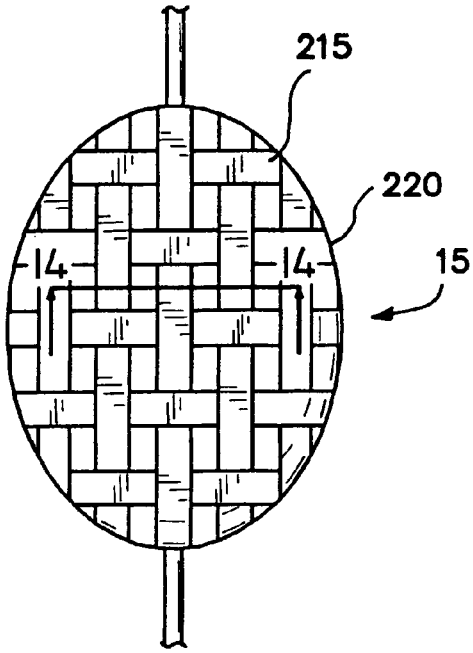
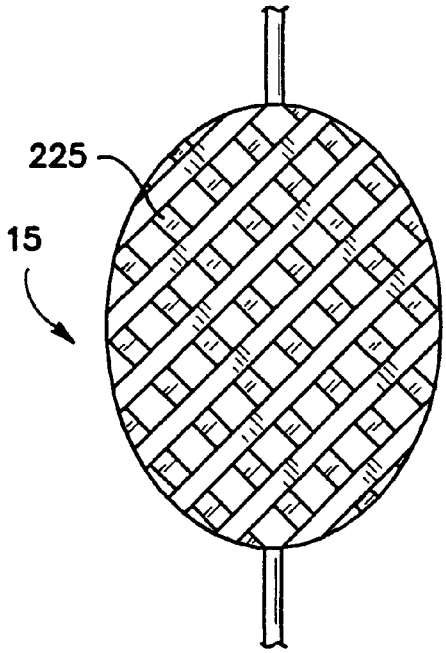
FIG. 13
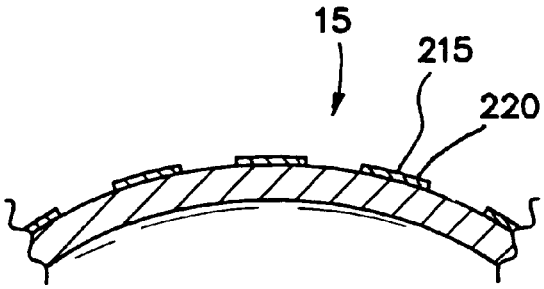
FIG. 14

FIG. 35
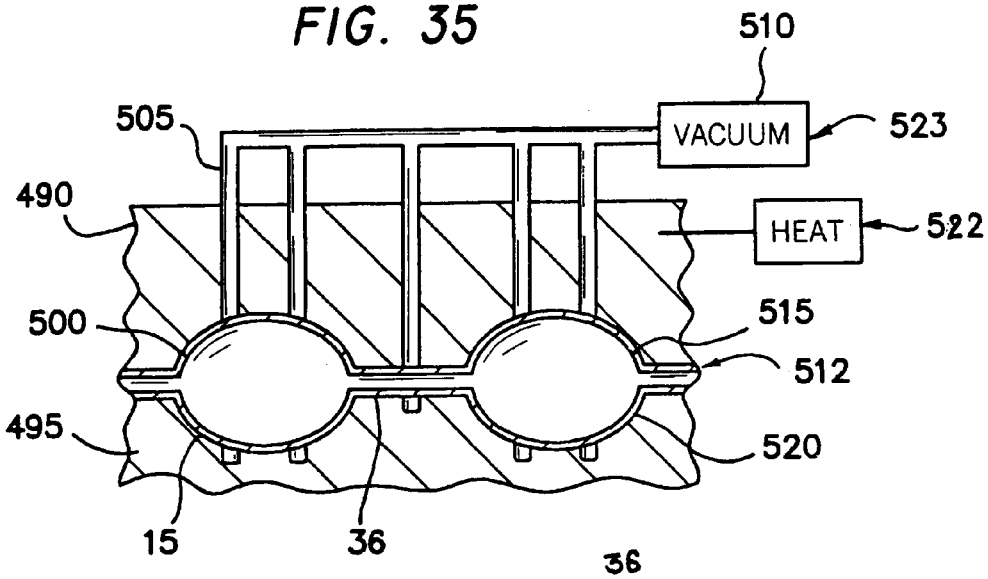
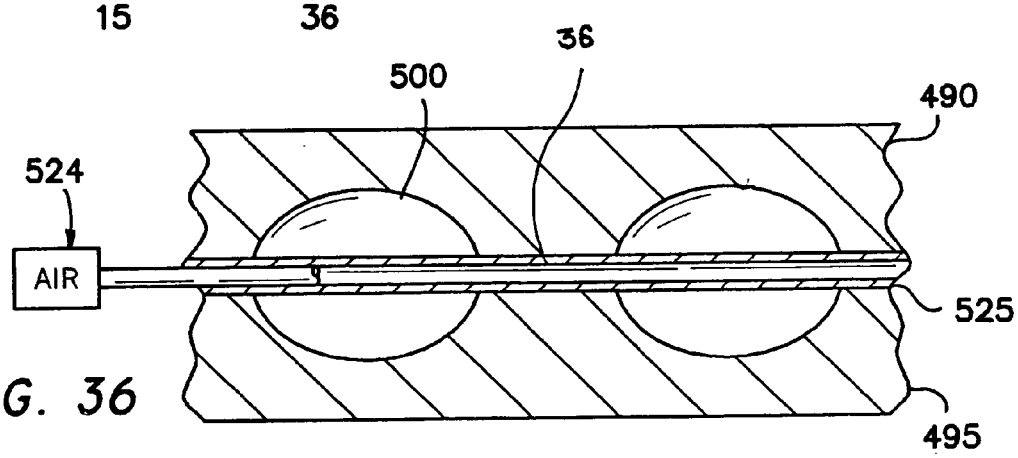
FIG. 36
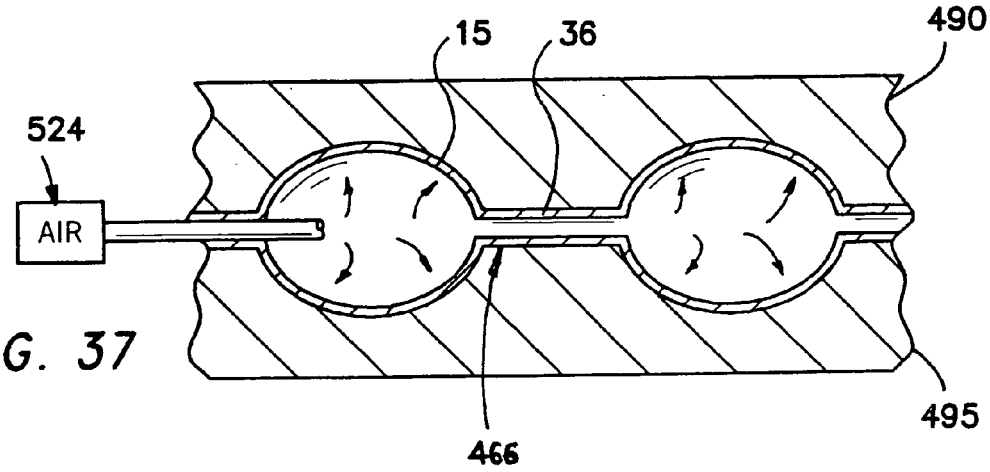
FIG. 37

OVOID FLEXIBLE PRESSURE VESSEL, APPARATUS AND METHOD FOR MAKING SAME

EARLIER FILED APPLICATION

The instant application is a continuation-in-part of applicant's prior application filed Nov. 14, 2002 and having Ser. No. 10/295,488 and currently pending, the disclosure of which is specifically incorporated by reference herein.

FIELD OF INVENTION

The invention pertains to devices for storing gases and fluids under pressure. More particularly, the invention relates to pressure vessels that are formed out of flexible materials and that can be made to conform to a variety of shapes.

BACKGROUND OF THE INVENTION

Typically, pressure vessels capable of containing liquids or gases at significant pressures have involved fixed shape cylinders or spheres formed of high-strength metals such as steel or aluminum. Such pressure vessels, while successful for their designed applications, involve a number of problems. First, such metallic cylinders are relatively heavy compared to the gases or fluids that they contain. Second, pressure cylinders contain all of the gas or liquid in a single space. Should the vessel rupture, the entire vessel is destroyed, often with a violent explosion sending shards of metal in all directions. Third, metallic cylinders have a definite shape and cannot be adapted to fit readily in many space-constrained applications. The present invention involves a number of small cells linked to each other by small conduits. The cells are collected in a flexible manifold that allows the collection of cells to be arranged in a variety of different configurations. A pressure vessel of this type can be lightweight, adaptable to a variety of spaces and unusual applications, and is inherently safer in rupture situations.

The present invention is easily adapted to a number of valuable applications through the use of modem, high-strength materials and manufacturing techniques. The pressure handling capability of the vessel can be enhanced through the use of braiding, hoop-winding and overlayment with flexible, high-strength fabric and braiding materials. The pressure vessel may then be further strengthened through the use of plastic resin coatings or the addition of external reinforcement rings. The purity of liquids or gases contained in the vessel may be controlled through the use of special lining tubes placed within the vessel cells during construction. The vessel cells may be prevented from collapsing as gasses or liquids are removed by the introduction of special sponges to the cells during fabrication. For certain special applications, the pressure vessel cells may be fitted with removable, resealable ports, permitting the introduction of relatively large matter into the cells.

A particular problem associated with pressure vessels operated at high pressure is the conditions under which they may fail. Metallic cylinders are particularly dangerous in this regard as they may fragment suddenly if aged or fatigued from many use cycles, even if equipped with overpressure release devices. The present invention provides for a number of controlled pressure release mechanisms that are easily incorporated into the flexible pressure vessels.

The use of numerous small linked pressure vessels also present problems related to effectively joining such vessels together. The present invention provides for novel manufacturing methods for joining such cells.

Various designs have been developed using linked cell technologies. U.S. Pat. No. 6,047,860 issued to Sanders, the present inventor, is directed to a container system for pressurized fluids. The system includes a plurality of ellipsoidal chambers connected by a tubular core. The apertures into each of the chambers are of comparatively small size so that the rate of evacuation may be controlled if a single chamber is ruptured. Thus, the vessels are resistant to explosive rupturing. The container system comprises a plurality of chambers and a tubular core. The size of the apertures in the core are pre-selected so as to control the rate of evacuation of pressurized fluid from chambers. Each of the chambers is generally ellipsoidal and molded of a synthetic material with open front and rear ends. The tubular core is sonically welded to the chamber shells and the exterior of the shells are wrapped with pressure resistant reinforcing filaments. A protective plastic coating is applied to the exterior of the filament wrapped shells.

U.S. Pat. No. 2,222,762 issued to Bebor et al., discloses hollow metal bodies and means for producing them. The hollow bodies described in this invention are particularly adapted for use as pressure vessels and may be produced from tubular bodies by expanding the walls. The zones may comprise spaced spheroids joined together by parts of the initial tube. The hollow bodies described are made by placing a cylindrical tube into a suitable mold and then heating until the metal possesses the plasticity for expanding. By exerting an axially directed compressive force against the ends of the tube and simultaneously applying a high fluid pressure within the tube, the tube ball is axially compressed or upset while portions of the wall are expanded against the walls of the mold surrounding the tube. By suitably adjusting the axial thrust and expanding pressures, the hollow body is formed to possess the same wall thickness and resistivity to pressure yet have the form of a plurality of spaced spheroids adjoined together by parts of the initial tube.

U.S. Pat. No. 4,946,056, issued to Stannard, is directed to a fabricated pressure vessel that is used for the containment of pressurized fluids. The multi-lobed tank comprises a series of cylindrical lobes connected side by side and separated by a septa. Openings or ports in the septa enable fluid communication between the lobes.

U.S. Pat. No. 2,823,668 issued to Van Court et al. describes an inflatable splint. The wrapper of the splint comprises a double layer of material defining a series of flexible fluid chambers divided into elongated enclosures by cementing or heat sealing. It should be noted that the chamber walls are left open at their upper and lower ends whereby all of the elongated fluid chambers are in fluid communication with one another.

U.S. Pat. No. 5,704,512 issued to Falk et al., discloses a vessel that is used for a pressure vessel and made of plastic. The vessel includes a centered tubular part interconnected to a plurality of interconnected fluid compartments distributed peripherally in an annular fashion and thus enclosing the central compartment. The vessels described in this invention may be used to hold liquefied petroleum gas, compressed air, as well as various fire-fighting materials.

While other variations exist, the above-described designs involving linked cell technologies are typical of those encountered in the prior art. It is an objective of the present invention to provide a flexible pressure vessel that is capable of maintaining gasses or liquids at relatively high pressures. It is a further objective to provide this capability in a vessel that is light in weight and that presents a significantly reduced risk of injury in rupture situations. It is a still further objective of the invention to provide a pressure vessel that may be easily adapted to a variety of space constraints. It is yet a further objective to provide a pressure vessel that is durable, easily serviced, and that may be produced inexpensively. It is still a further objective of the invention to provide means for easily increasing the pressure handling capability of the vessel through the addition of external overwrapping, banding or overlayment with high-strength materials.

It is another objective to provide means for controlling the purity of liquids or gasses introduced into the vessel. Further, it is an objective to provide means for introducing solid material into the pressure cells of the vessel through resealable ports in the vessel pressure cells. It is also an objective of this invention to provide for flexible pressure vessels that provide for a controlled release of pressure in overpressure situations. Finally, it is an objective of the invention to provide for safe, efficient and effective means for joining multiple flexible pressure vessels together.

While some of the objectives of the present invention are disclosed in the prior art, none of the inventions found include all of the requirements identified.

SUMMARY OF THE INVENTION (1) An ovoid flexible pressure vessel providing the desired features may be constructed from the following components. At least one hollow pressure cell is provided. The pressure cell has symmetrical upper and lower cell portions. The pressure cell is formed of resilient material and has an outer surface, an inner surface, an outer perimeter and at least one opening located at the outer perimeter. A passageway is provided. The passageway has a first end and a second end and is attached to the at least one opening at the first end and extends outwardly as a connection to either a passageway of another cell or a valve. At least one reinforcing ring is provided. The reinforcing ring has an inner surface, an outer surface, an outer circumference, is formed of high-strength material and is sized and shaped to fit tightly about the outer perimeter of the pressure cell. The reinforcing ring has an aperture. The aperture extends from the inner surface to the outer surface and is sized, shaped and located to accommodate connection of the passageway to the pressure cell. A valving means is provided. The valving means is capable of controlling a flow of either a liquid or a gas through the passageway and is attached to the second end of the passageway. When the reinforcing ring is located about the outer perimeter of the pressure cell, the pressure handling capacity of the cell is increased.

(2) In a variant of the invention, at least one upper dome-shaped cell portion is provided. The upper cell portion is formed from resilient material and has an outer surface, an inner surface, an inner perimeter, an outer perimeter and at least one upper opening portion. The upper opening portion extends outwardly from the inner perimeter. At least one mating lower dome-shaped cell portion is provided. The lower cell portion is formed from resilient material and has an outer surface, an inner surface, an inner perimeter, an outer perimeter and at least one lower opening portion. The lower opening portion extends outwardly from the inner perimeter. The upper cell portion is joined to the mating lower cell portion such that a hollow pressure cell is formed. The cell has at least one opening. A passageway is provided. The passageway has a first end and a second end and is attached to the at least one opening at the first end and extends outwardly as a connection to either a passageway of another cell or a valve.

At least one reinforcing ring is provided. The reinforcing ring has an inner surface, an outer surface, an outer circumference, is formed of high-strength material and is sized and shaped to fit tightly about the outer perimeter of the pressure cell. The reinforcing ring has an aperture. The aperture extends from the inner surface to the outer surface and is sized, shaped and located to accommodate connection of the passageway to the pressure cell. A valving means is provided. The valving means is capable of controlling a flow of either a liquid or a gas through the passageway and is attached to the second end of the passageway.

(3) In another variant of the invention, a protruding rim is provided. The protruding rim is located at the outer perimeter of the pressure cell. Upper and lower receiving notches are provided. The upper and lower receiving notches are located above and below the protruding rim. Upper and lower projecting ribs are provided. The upper and lower projecting ribs are located upon the inner surface of the reinforcing ring. A central receiving notch is provided. The central receiving notch is located between the upper and lower projecting ribs. The projecting ribs are sized, shaped and located to fit the upper and lower receiving notches of the pressure cell. The central receiving notch is sized, shaped and located to fit the protruding rim of the pressure cell. When the reinforcing ring is located about the outer perimeter of the pressure cell, the pressure handling capacity of the cell is increased.

(4) In another variant, at least one upper dome-shaped cell portion is provided. The upper cell portion is formed from resilient material and has an outer surface, an inner perimeter, an outer perimeter and at least one upper passageway portion. The upper passageway portion extends outwardly from the inner perimeter. At least one mating lower dome-shaped cell portion is provided. The lower cell portion is formed from resilient material and has an outer surface, an inner perimeter, an outer perimeter and at least one lower passageway portion. The lower passageway portion extends outwardly from the inner perimeter. The upper cell portion is joined to the mating lower cell portion such that a hollow pressure cell is formed. The cell has at least one passageway extending outwardly from the cell as a connection to either a passageway of another cell or a valve.

A protruding rim is provided. The protruding rim is located at the outer perimeter of the pressure cell. Upper and lower receiving notches are provided. The upper and lower receiving notches are located above and below the protruding rim. Upper and lower reinforcing rings are provided. Each of the reinforcing rings has an inner surface, an outer surface, is formed of high-strength material and is sized and shaped to fit tightly in either the upper or lower receiving notches. At least one of the reinforcing rings has an aperture. The aperture extends from the inner surface to the outer surface and is sized, shaped and located to accommodate connection of the passageway to the pressure cell. When the reinforcing rings are located about the outer perimeter of the pressure cell, the pressure handling capacity of the cell is increased.

(5) In yet a further variant of the invention, means are provided for fastening the upper reinforcing ring to the lower reinforcing ring.

(6) In yet a further variant, at least one upper dome-shaped cell portion is provided. The upper cell portion is formed from resilient material and has an outer surface, an inner perimeter, an outer perimeter and at least one upper passageway portion. The upper passageway portion extends outwardly from the inner perimeter. At least one mating lower dome-shaped cell portion is provided. The lower cell portion is formed from resilient material and has an outer surface, an inner perimeter, an outer perimeter and at least one lower passageway portion. The lower passageway portion extends outwardly from the inner perimeter.

The upper cell portion is joined to the mating lower cell portion such that a hollow pressure cell is formed. The cell has at least one passageway extending outwardly from the cell as a connection to either a passageway of another cell or a valve. A protruding rim is provided. The protruding rim is located at the outer perimeter of the pressure cell. At least one groove located about the outer perimeter above the protruding rim is provided. Upper and lower reinforcing rings are provided. Each of the reinforcing rings has an inner surface, an outer surface, is formed of high-strength material and is sized and shaped to fit tightly about the outer perimeter on either side of the protruding rim.

The reinforcing rings have at least one rib located upon the inner surface thereof. The rib is sized, shaped and located to engage the groove. When the reinforcing rings are located about the outer perimeter of the pressure cell, the pressure handling capacity of the cell is increased.

(7) In still a further variant of the invention, means are provided for fastening the upper reinforcing ring to the lower reinforcing ring.

(8) In another variant of the invention, an overwrapping layer is provided. The overwrapping layer is formed of high-strength braiding material wound around the hollow pressure cell. When the hollow pressure cell is overwrapped with high-strength braiding material, the pressure handling capacity of the pressure cell is increased.

(9) In yet a further variant of the invention, hoop winding is provided. The hoop winding is around the hollow pressure cell to increase the pressure handling capacity of the pressure cell.

(10) In still a further variant, a plastic overcoating is provided.

(11) In yet a further variant, a first flexible blanket is provided. The first blanket has an upper surface, a lower surface and is sized and shaped to cover the upper cell portion and extends outwardly beyond the outer perimeter. The first blanket is fixedly attached at its lower surface to the outer surface of the upper cell portion. A second flexible blanket is provided. The second blanket has an upper surface, a lower surface and is sized and shaped to cover the lower cell portion and extends outwardly beyond the outer perimeter. The second blanket is fixedly attached at its upper surface to the outer surface of the lower cell portion.

(12) In another variant, heavy duty stitching is used to attach the first blanket to the second blanket. The stitching penetrates the first and second blankets between the cell portions and serves to further reinforce and increase the pressure-handling capabilities of the pressure cell.

(13) In another variant, the heavy duty stitching is high pressure hoop and lock braiding.

(14) In still a further variant of the invention, a cell-shaped sponge is inserted between the upper cell portion and the lower cell portion prior to joining the upper and lower cell portions. The sponge serves to prevent the cell from collapsing after either gas or liquid is removed from the cell.

(15) In another variant of the invention, the sponge is impregnated with a zeolite compound, a gas or liquid absorbing compound or a reactive fuel cell compound.

(16) In still another further variant, either a heat-reflecting plastic film or a metal foil is inserted between at least one of the first blanket and the upper cell portion or the second blanket and the lower cell portion.

(17) In yet a another variant of the invention, the upper cell portion is joined to the lower cell portion by either radio frequency welding or high strength adhesive.

(18) In still a further variant, either the first and second blankets are formed of high-strength fiber impregnated material.

(19) In still another variant of the invention, the passageway has a cross-section of between 0.025 and 0.250 inches.

(20) In yet a further variant, an upper retaining plate is provided. The upper retaining plate has a third inner circumference, an outer circumference and a third predetermined thickness. The upper retaining plate is sized and shaped to fit over the upper cell portion and surround its outer perimeter when the upper cell portion is covered by the first blanket. The third inner circumference is larger than the outer circumference of the reinforcing ring. A lower retaining plate is provided. The lower retaining plate has a fourth inner circumference, an outer circumference and a fourth pre-determined thickness. The lower retaining plate is sized and shaped to fit over the lower cell portion and surround its outer perimeter when the lower cell portion is covered by the second blanket. The fourth inner circumference is larger than the outer circumference of the reinforcing ring. Means are provided for attaching the upper retaining plate to the lower retaining plate. When the upper retaining plate is attached to the lower retaining plate, surrounding the upper and lower cell portions and the first and second blankets covering the reinforcing ring, the pressure capacity of the cell will be increased.

(21) In another variant, means are provided for attaching the upper retaining plate to the lower retaining plate. A series of holes are provided. The holes penetrate the upper retaining plate between its outer circumference and the third inner circumference. The holes also penetrate the lower retaining plate between its outer circumference and the fourth inner circumference, the first blanket, a border of sheet material surrounding the outer perimeter of the upper cell portion, a border of sheet material surrounding the outer perimeter of the lower cell portion and the second blanket. The holes are outside of the outer circumference of the reinforcing ring. A series of fastening means is provided. The fastening means are sized and shaped to pass through the series of holes and are capable of securing the upper retaining plate to the lower retaining plate.

(22) In yet a further variant of the invention, the fastening means is a series of bolt and locking nuts.

(23) In another variant of the invention, the fastening means is a series of rivets.

(24) In still a further variant, the means for attaching the upper retaining plate to the lower retaining plate further includes a series of holes. The holes penetrate the upper retaining plate between its outer circumference and the third inner circumference, the first blanket, a border of sheet material surrounding the outer perimeter of the upper cell portion, a border of sheet material surrounding the outer perimeter of the lower cell portion and the second blanket. The holes are outside of the outer circumference of the reinforcing ring. A series of pins are provided. The pins are affixed orthogonally along an upper surface of the lower retaining plate and are sized, shaped and located to fit slidably through the series of holes and extends slightly above an upper surface of the upper retaining plate. A series of welds are provided. The welds fixedly attach the pins to the upper retaining plate, thereby securing the upper and lower retaining plates to each other.

(25) In yet a further variant of the invention, a series of cell shaped sponges are provided. A tube is provided. The tube is formed of flexible gas and liquid impervious material and is sized and shaped to surround the sponges. The sponges are inserted in the tube at spaced intervals. The encased sponges are inserted between the upper cell portions and the lower cell portions prior to joining the upper and lower cell portions. The tube extends through the passageways. The sponges serve to prevent the cells from collapsing after either gas or liquid is removed from the cells. The tube serves to prevent contamination of either gas or liquid by the inner surfaces of the upper and lower cell portions.

(26) In another variant of the invention, the sponges are impregnated with a zeolite compound, a gas or liquid absorbing compound or a reactive fuel cell compound.

(27) In another variant, the tube is formed from material selected from the group comprising: thermoplastic polyurethane elastomer, polyurethane polyvinyl chloride, polyvinyl chloride, thermoplastic elastomer, Teflon® and polyethylene.

(28) In still a further variant of the invention, upper and lower reinforcing panels are provided. The reinforcing panels are formed of high-strength woven material and are substantially ovoid in shape with extensions projecting from a perimeter of the ovoid shape. The reinforcing panels are adhered to the outer surfaces of the upper and lower cell portions of the hollow pressure cell, thereby increasing the pressure handling capabilities of the pressure cell.

(29) In another variant of the invention, the method of adhesion is selected from the group comprising: high-strength adhesive, sonic welding, and RF welding.

(30) In another variant, the woven material is prepregnated with either adhesive or laminating material and subjected to heat and pressure.

(31) In yet a further variant of the invention, the passageway is removably attached to the hollow pressure cell.

(32) In another variant of the invention, the passageway is removably attached to the hollow pressure cell by a threaded fitting. The threaded fitting is sized and shaped to fit a threaded opening at the outer perimeter of the hollow pressure cell.

(33) In still a further variant of the invention, an orifice is provided. The orifice penetrates either the upper or lower cell portions. A removable plug is provided. The removable plug is sized and shaped to fit sealably into the orifice, thereby permitting introduction of material into the pressure cell.

(34) An apparatus for fabricating an ovoid flexible pressure vessel may be constructed from the following components. An internal core form is provided. The internal core form has the internal shape of a hollow pressure cell, an internal passageway and a plurality of outlet blow holes connected to the passageway. An open top vessel is provided. The vessel contains a solution of liquid plastic. Means are provided for moving the internal core form into and out of the solution. Means are provided for pumping either pressurized gas or liquid into the passageway, thereby causing the liquid plastic to expand about the internal core form to form a hollow pressure cell. The pressure cell has symmetrical upper and lower cell portions, is formed of resilient material and has an outer surface, an outer perimeter and at least one opening located at the outer perimeter. Means are provided for extracting the internal core form from the hollow pressure cell. Means are provided for connecting a passageway to the at least one opening for connection to either a passageway of another cell or a valve. Means are provided for pressing a reinforcing ring onto the outer perimeter. The reinforcing ring has an inner surface, an outer surface, is formed of high-strength material and is sized and shaped to fit tightly about the outer perimeter of the pressure cell. The reinforcing ring has an aperture. The aperture extends from the inner surface to the outer surface and is sized, shaped and located to accommodate connection of the passageway to the pressure cell. Means are provided for attaching a valving means to the passageway. The valving means is capable of controlling a flow of either a liquid or a gas through the passageway and is attached to the second end of the passageway. When the reinforcing ring is located about the outer perimeter of the pressure cell, the pressure handling capacity of the cell is increased.

(35) In a variant of the apparatus for fabricating an ovoid flexible pressure vessel, means are provided for forming a protruding rim at an outer perimeter of the hollow pressure cell. The protruding rim has upper and lower receiving notches located above and below the protruding rim. The reinforcing ring has an outer surface, an inner surface, upper and lower projecting ribs and a central receiving notch located between the upper and lower projecting ribs. The projecting ribs are sized, shape and located to fit the upper and lower receiving notches of the pressure cell. The central receiving notch is sized, shaped and located to fit the protruding rim of the pressure cell.

(36) In yet a further variant of the apparatus for fabricating an ovoid flexible pressure vessel, first and second symmetrical external mold portions are provided. Each of the mold portions has at least one cavity reflecting the external shape of a hollow pressure cell and a connecting internal passageway. The cavity has at least one vacuum passage connecting to an external vacuum source. First and second sheets of moldable thermoplastic material are provided. Means are provided for inserting the sheets of thermoplastic material between the mold portions. Means are provided for heating the mold portions and the sheets. Means are provided for applying vacuum to the vacuum passages, thereby forming a hollow pressure cell. Means are provided for removing the hollow pressure cell from the mold portions. Means are provided for pressing a reinforcing ring onto the outer perimeter. The reinforcing ring has an inner surface, an outer surface, is formed of high-strength material and is sized and shaped to fit tightly about the outer perimeter of the pressure cell. The reinforcing ring has an aperture. The aperture extends from the inner surface to the outer surface and is sized, shaped and located to accommodate connection of the passageway to the pressure cell. Means are provided for attaching a valving means to the passageway. The valving means is capable of controlling a flow of either a liquid or a gas through the passageway and is attached to the second end of the passageway. When the reinforcing ring is located about the outer perimeter of the pressure cell, the pressure handling capacity of the cell is increased.

(37) In another variant of the apparatus for fabricating an ovoid flexible pressure vessel, means are provided for forming a protruding rim at an outer perimeter of the hollow pressure cell. The protruding rim has upper and lower receiving notches located above and below the protruding rim. The reinforcing ring has an outer surface, an inner surface, upper and lower projecting ribs and a central receiving notch located between the upper and lower projecting ribs. The projecting ribs are sized, shaped and located to fit the upper and lower receiving notches of the pressure cell. The central receiving notch is sized, shaped and located to fit the protruding rim of the pressure cell.

(38) In still a further variant of the apparatus for fabricating an ovoid flexible pressure vessel, first and second symmetrical external mold portions are provided. Each of the mold portions has at least one cavity reflecting the external shape of a hollow pressure cell and a connecting internal passageway. Means are provided for extruding a plastic tube between the mold portions and pressurizing the plastic tube to form the hollow pressure cell with attached connecting internal passageway. Means are provided for removing the hollow pressure cell with attached passageway from the mold portions. Means are provided for connecting a passageway to the at least one opening for connection to either a passageway of another cell or a valve. Means are provided for pressing a reinforcing ring onto the outer perimeter. The reinforcing ring has an inner surface, an outer surface, is formed of high-strength material and is sized and shaped to fit tightly about the outer perimeter of the pressure cell. The reinforcing ring has an aperture. The aperture extends from the inner surface to the outer surface and is sized, shaped and located to accommodate connection of the passageway to the pressure cell. Means are provided for attaching a valving means to the passageway. The valving means is capable of controlling a flow of either a liquid or a gas through the passageway and is attached to the second end of the passageway. When the reinforcing ring is located about the outer perimeter of the pressure cell, the pressure handling capacity of the cell is increased.

(39) In yet a further variant of the apparatus for fabricating an ovoid flexible pressure vessel, means are provided for forming a protruding rim at an outer perimeter of the hollow pressure cell. The protruding rim has upper and lower receiving notches located above and below the protruding rim. The reinforcing ring has an outer surface, an inner surface, upper and lower projecting ribs and a central receiving notch located between the upper and lower projecting ribs. The projecting ribs are sized, shaped and located to fit the upper and lower receiving notches of the pressure cell. The central receiving notch is sized, shaped and located to fit the protruding rim of the pressure cell.

(40) In still a further variant of the apparatus for fabricating an ovoid flexible pressure vessel, first and second rolls of planar resilient material are provided. First and second thermal die stamping stations are provided. The stamping stations are capable of forming upper and lower cell portions of a hollow pressure cell and a connecting internal passageway. Means are provided for moving resilient material from the first and second rolls of planar resilient material into the first and second thermal die stamping stations. A radio frequency welder is provided. The welder is capable of joining the upper cell portion to the lower cell portion. Means are provided for moving the upper and lower cell portions into the radio frequency welder, thereby joining the upper and lower cell portions and forming the internal connecting passageway. Means are provided for pressing upper and lower reinforcing rings onto the hollow pressure cell adjacent the outer perimeter. The reinforcing rings have an inner surface, an outer surface, are formed of high-strength material and are sized and shaped to fit tightly about the outer perimeter of the pressure cell. At least one of the reinforcing rings has an aperture. The aperture extends from the inner surface to the outer surface and is sized, shaped and located to accommodate connection of the passageway to the pressure cell. Means are provided for attaching a valving means to the passageway. The valving means is capable of controlling a flow of either a liquid or a gas through the passageway and is attached to the second end of the passageway. When the reinforcing rings are located about the outer perimeter of the pressure cell, the pressure handling capacity of the cell is increased.

(41) In yet a further variant of the apparatus for fabricating an ovoid flexible pressure vessel, means are provided for forming a protruding rim at an outer perimeter of the hollow pressure cell. Means are provided for forming at least one groove located about the outer perimeter above the protruding rim. Means are provided for forming at least one groove located about the outer perimeter below the protruding rim. Each of the upper and lower reinforcing rings has an inner surface, an outer surface, is formed of high-strength material and is sized and shaped to fit tightly about the outer perimeter on either side of the protruding rim. The reinforcing rings have at least one rib located upon the inner surface thereof. The rib is sized, shaped and located to engage the groove.

(42) In another variant of the apparatus for fabricating an ovoid flexible pressure vessel, means are provided for fastening the upper reinforcing ring to the lower reinforcing ring.

(43) In yet a further variant of the apparatus for fabricating an ovoid flexible pressure vessel, first and second rolls of high-strength fiber impregnated blanket material are provided. Means are provided for attaching the first and second blankets over upper and lower surfaces of the hollow pressure cell.

(44) In still a further variant of the apparatus for fabricating an ovoid flexible pressure vessel, means are provided for overwrapping the hollow pressure cell and reinforcing ring with high-strength braiding material, thereby increasing the pressure handling capability of the hollow pressure cell.

(45) In yet a further variant of the apparatus for fabricating an ovoid flexible pressure vessel, means are provided for hoop winding the hollow pressure cell and reinforcing ring, thereby increasing the pressure handling capacity of the pressure cell.

(46) In another variant, the apparatus for fabricating an ovoid flexible pressure vessel has a means for adhering reinforcing panels to an outer surface of the upper and lower cell portions of a hollow pressure cell, thereby increasing the pressure handling capabilities of the pressure cell.

(47, 48, 49) In an additional variant of the apparatus for fabricating an ovoid flexible pressure vessel, a means for applying a plastic overcoating is provided.

(50) In still a further variant of the apparatus for fabricating an ovoid flexible pressure vessel, a series of cell-shaped sponges are provided. Means are provided for inserting the cell-shaped sponges between the upper and lower cell portions prior to joining the upper and lower cell portions.

(51) In yet a further variant of the apparatus for fabricating an ovoid flexible pressure vessel, first and second rolls of either heat-reflecting plastic film or metal foil are provided. Means are provided for attaching either heat-reflecting plastic film or metal foil to the outer surface of at least one of the upper cell portion and the lower cell portion.

(52) In still a further variant of the apparatus for fabricating an ovoid flexible pressure vessel, means are provided for moving blanketed cells to a high-pressure hoop and lock braiding machine.

(53) In yet a further variant of the apparatus for fabricating an ovoid flexible pressure vessel, a series of cell-shaped sponges are provided. A tube is provided. The tube is formed of flexible gas and liquid impervious material and is sized and shaped to surround the sponges. Means are provided for inserting the sponges in the tube at spaced intervals. Means are provided for inserting the encased sponges between the upper cell portions and the lower cell portions prior to joining the upper and lower cell portions. The tube extends through the passageway.

(54) In still a further variant of the apparatus for fabricating an ovoid flexible pressure vessel, means are provided for positioning an upper retaining plate to fit over the upper cell portion and surround its outer perimeter when the upper cell portion is covered by the first blanket. Means are provided for positioning a lower retaining plate to fit over the lower cell portion and surround its outer perimeter when the lower cell portion is covered by the second blanket. Means are provided for producing a series of holes. The holes penetrate the upper retaining plate between its outer circumference and the third inner circumference, the lower retaining plate between its outer circumference and the fourth inner circumference and the first blanket, a border of sheet material surrounding the outer perimeter of the upper cell portion, a border of sheet material surrounding the outer perimeter of the lower cell portion and the second blanket. The holes are outside of the outer circumference of the reinforcing ring. Means are provided for inserting and securing fastening means through the holes, thereby securing the upper and lower retaining plates to each other.

(73) In another variant of the invention, the flexible pressure vessel has a first pressure relief device. The first pressure relief device is located on the inner surface of the hollow pressure cell and has a reduction in thickness of the hollow pressure cell at a predetermined location. When the hollow pressure cell is subjected to an overpressure condition it will fail at the predetermined location.

(74) In yet another variant of the invention, the first pressure relief device has an indentation in the inner surface of the hollow pressure cell. The indentation has side walls angled inwardly from the inner surface.

(75) In still another variant of the invention, the ovoid flexible pressure vessel has a first pressure relief device. The first pressure relief device is located on the inner surface of either the upper dome-shaped cell portion or the lower dome-shaped cell portion and has a reduction in thickness of one of the dome-shaped cell portions at a predetermined location. When said hollow pressure cell is subjected to an overpressure condition it will fail at said predetermined location.

(76) In a further variant, the first pressure relief device has an indentation in the inner surface of either the upper dome-shaped cell portion or the lower dome-shaped cell portion. The indentation has side walls angled inwardly from the inner surface.

(77) In another variant, the ovoid flexible pressure vessel has a second pressure relief device. The second pressure relief device is located on the outer surface of the hollow pressure cell and has at least one projecting member. The projecting member is sized and shaped to penetrate the high-strength braiding material at a predetermined location. When the braiding material is penetrated by the projecting member and the hollow pressure cell is subjected to an overpressure condition, the cell will fail at the predetermined location.

(78) In yet another variant, the projecting member is removably attached to the outer surface of the hollow pressure cell.

(79) In still a further variant, the ovoid flexible pressure vessel has a second pressure relief device. The second pressure relief device is located on the outer surface of the hollow pressure cell and has at least one projecting member. The projecting member is sized and shaped to penetrate the hoop winding at a predetermined location. When the hoop winding is penetrated by the projecting member and the hollow pressure cell is subjected to an overpressure condition, the cell will fail at the predetermined location.

(80) In another variant of the invention, the at least one projecting member is removably attached to the outer surface of the hollow pressure cell.

(81) In yet another variant of the invention, the ovoid flexible pressure vessel has a second pressure relief device. The second pressure relief device is located on the outer surface of the hollow pressure cell and has at least one projecting member. The projecting member is sized and shaped to penetrate either the first flexible blanket or the second flexible blanket at a predetermined location. When either the first flexible blanket or the second flexible blanket is penetrated by the projecting member and the hollow pressure cell is subjected to an overpressure condition, the cell will fail at the predetermined location.

(82) In still a another variant of the invention the projecting member is removably attached to the outer surface of the hollow pressure cell.

(83) In another embodiment, the ovoid flexible pressure vessel has a second pressure relief device. The second pressure relief device is located upon the outer surface of the hollow pressure cell and has at least one projecting member. The projecting member is sized and shaped to penetrate either the upper or lower reinforcing panels at a predetermined location. When either the upper or lower reinforcing panels is penetrated by the projecting member and the hollow pressure cell is subjected to an overpressure condition, the cell will fail at the predetermined location.

(84) In yet another variant, the projecting member is removably attached to the outer surface of the hollow pressure cell.

(85) In still another variant, the ovoid flexible pressure vessel has a third pressure relief device. The third pressure relief device has a weakened section of the passageway. When the hollow pressure cell is subjected to an overpressure condition, the cell will fail at the weakened section of the passageway.

(86) In a another variant, the weakened section of the passageway has a smaller cross-sectional area than a balance of the passageway.

(87) In a further variant, the ovoid flexible pressure has a high-strength braiding material wound about the passageway, thereby providing additional resistance to pressure in the flexible pressure vessel.

(88) In yet another variant, the ovoid flexible pressure vessel has a fourth pressure relief device. The fourth pressure relief device has either a weakening or an absence of high-strength braiding material at a predetermined location along the passageway. When the hollow pressure cell is subjected to an overpressure condition, the cell will fail at the predetermined location along the passageway.

(89) In still another variant, the ovoid flexible pressure has hoop winding about the passageway, thereby providing additional resistance to pressure in the flexible pressure vessel.

(90) In another variant of the invention, the ovoid flexible pressure vessel has a fifth pressure relief device. The fifth pressure relief device has either a weakening or an absence of hoop winding at a predetermined location along the passageway. When the hollow pressure cell is subjected to an overpressure condition, the cell will fail at the predetermined location along the passageway.

(91) In a further variant of the invention, the ovoid flexible pressure vessel has either a weakening or a spreading of fibers in either of the first flexible blanket or the second flexible blanket at a predetermined location. The predetermined location is above the outer surface of either the upper cell portion or the lower cell portion. When either the first flexible blanket or the second flexible blanket has the fibers weakened or spread in the predetermined location and the hollow pressure cell is subjected to an overpressure condition, the cell will fail at the predetermined location.

(92) In yet another variant of the invention, the ovoid flexible pressure vessel has either a weakening or a spreading of fibers in either the upper or lower reinforcing panels at a predetermined location. The predetermined location is above the outer surface of either of the upper cell portion or the lower cell portion. When either the upper or lower reinforcing panels has the fibers weakened or spread in the predetermined location and the hollow pressure cell is subjected to an overpressure condition, the cell will fail at the predetermined location.

(93) In still a further variant of the invention, the connection to either a passageway of another cell or a valve has a capillary tube. The capillary tube has a proximate end and a distal end and is formed of resilient material. The tube is sized and shaped to fit slidably within the passageway.

The connection to either a passageway of another cell or a valve also has a high-strength braiding material. The braiding material is located about the capillary tube and extends along the tube to within a first predetermined distance from the proximate end.

The proximate end of the braiding covered capillary tube is inserted into the passageway and either radio frequency welded or secured with adhesive. When the proximate end of the capillary tube is either welded or secured with adhesive within the passageway, it will be permanently attached to it.

(94) In another variant, an apparatus for making the ovoid flexible pressure vessel is provided. The apparatus has a means for supporting a supply roll of flexible blanket material. A means for moving the flexible blanket material from the supply roll to a work area is provided. Means for tensioning the flexible blanket material in the work area are also provided. At least one separating member is provided. The separating member is sized and shaped to penetrate and separate fibers of the flexible blanket material.

Means for moving the separating member into the tensioned flexible blanket material at a predetermined location in the material, thereby either weakening or separating the fibers, is provided. Means for retracting the separating member from the tensioned flexible blanket material is provided. Means for moving the flexible blanket material from the work area to a storage area is provided. The flexible blanket material will have either weakened or separated fibers in the predetermined location prior to application to the hollow pressure cell.

(95) In a further variant, an apparatus for making the ovoid flexible pressure vessel is provided. The apparatus has a means for supporting a supply roll of reinforcing panel material is provided. Means for moving the reinforcing panel material from the supply roll to a work area is provided. Means for tensioning the reinforcing panel material in the work area is provided.

At least one separating member is provided. The separating member is sized and shaped to penetrate and separate fibers of the reinforcing panel material. Means for moving the separating member into the tensioned reinforcing panel material at a predetermined location in the material, thereby either weakening or separating the fibers, is provided. Means for retracting the separating member from the tensioned reinforcing panel material is provided. Means for moving the reinforcing panel material from the work area to a storage area is provided. The reinforcing panel material will have either weakened or separated fibers in the predetermined location prior to application to the hollow pressure cell.

(96) In yet another variant, a method for making the ovoid flexible pressure vessel is provided. The method includes: providing a supply roll of flexible blanket material, supporting the supply roll, moving the flexible blanket material from the supply roll to a work area, tensioning the flexible blanket material in the work area, providing at least one separating member. The separating member is sized and shaped to penetrate and separate fibers of the flexible blanket material.

The method also includes moving the separating member into the tensioned flexible blanket material at a predetermined location in the material, thereby either weakening or separating the fibers. The method includes retracting the separating member from the tensioned flexible blanket material. Finally, the method includes moving the flexible blanket material from the work area to a storage area. The flexible blanket material will have either weakened or separated fibers in the predetermined location prior to application to the hollow pressure cell.

(97) In a final variant, a method for making the ovoid flexible pressure vessel is provided. The method includes: providing a supply roll of reinforcing panel material, means for supporting the supply roll, moving the reinforcing panel material from the supply roll to a work area, tensioning the reinforcing panel material in the work area, providing at least one separating member. The separating member is sized and shaped to penetrate and separate fibers of the reinforcing panel material.

The method also includes moving the separating member into the tensioned reinforcing panel material at a predetermined location in the material, thereby either weakening or separating the fibers. The method further includes retracting the separating member from the tensioned reinforcing panel material and moving the reinforcing panel material from work area to a storage area. The reinforcing panel material will have either weakened or separated fibers in said predetermined location prior to application to said hollow pressure cell.

DESCRIPTION OF THE DRAWINGS

5

FIG. 12 is a plan view of the FIG. 1 embodiment overwrapped with high strength braiding material;

FIG. 13 is a plan view of the FIG. 1 embodiment including hoop winding overwrapping;

FIG. 14 is a partial cross-sectional view of the FIG. 12 embodiment taken along the line 14—14;

FIG. 35 is a cross-sectional view of an apparatus for forming a pressure cell using a vacuum forming technique;

FIG. 36 is a cross-sectional view of an apparatus for forming a pressure cell using an extruded plastic tube inflated inside of a two-part mold;

FIG. 37 is a cross-sectional view of an apparatus for forming a pressure cell using an extruded plastic tube inflated inside of a two-part mold illustrating the cells after inflation of the tube;

Figure 1:
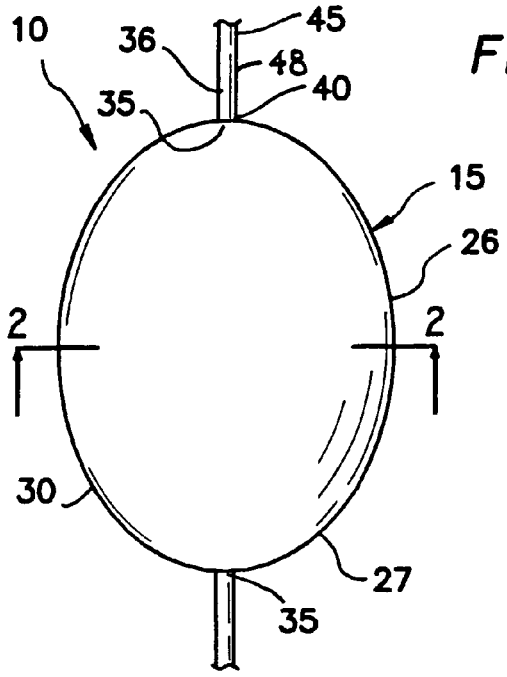
FIG. 1 is a plan view of a first embodiment of the ovoid flexible pressure vessel illustrating connecting passageways.
Figure 3:
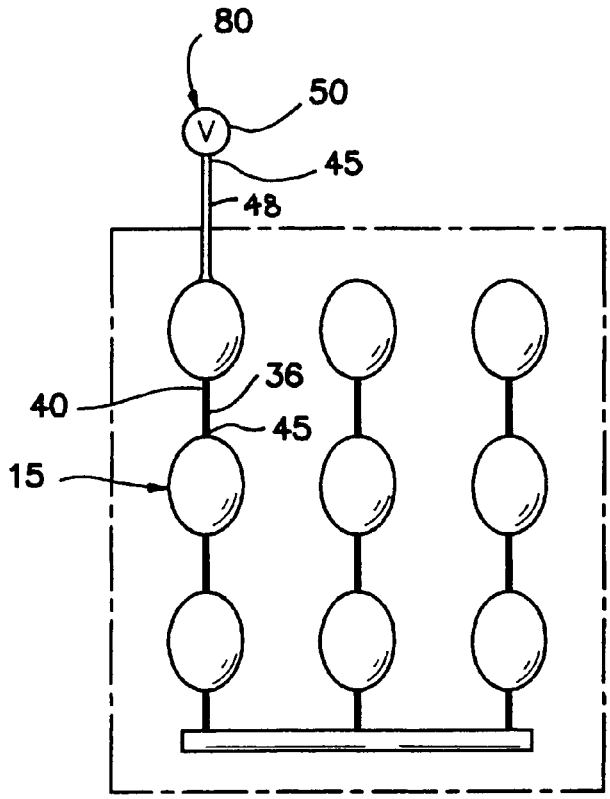
FIG. 3 is a plan view of a series of pressure vessels connected to a manifold and a valve.

DETAILED DESCRIPTION OF THE PREFERRED EMBODIMENT (1) An ovoid flexible pressure vessel 10, as shown in FIGS. 1–4, providing the desired features may be constructed from the following components. At least one hollow pressure cell 15 is provided. The pressure cell 15 has symmetrical upper 20 and lower 25 cell portions. The pressure cell 15 is formed of resilient material 26 and has an outer surface 27, an inner surface 28, an outer perimeter 30 and at least one opening 35 located at the outer perimeter 30. A passageway 36 is provided. The passageway 36 has a first end 40 and a second end 45 and is attached to the at least one opening 35 at the first end 40 and extends outwardly as a connection 48 to either a passageway 36 of another cell 15 or a valve 50. At least one reinforcing ring 55 is provided. The reinforcing ring 55 has an inner surface 60, an outer surface 65, an outer circumference 76, is formed of high-strength material 70 and is sized and shaped to fit tightly about the outer perimeter 30 of the pressure cell 15. The reinforcing ring 55 has an aperture 75. The aperture 75 extends from the inner surface 60 to the outer surface 65 and is sized, shaped and located to accommodate connection 48 of the passageway 36 to the pressure cell 15. A valving means 80 is provided. The valving means 80 is capable of controlling a flow of either a liquid or a gas through the passageway 36 and is attached to the second end 45 of the passageway 36. When the reinforcing ring 55 is located about the outer perimeter 30 of the pressure cell 15, the pressure handling capacity of the cell 15 is increased.

(2) In a variant of the invention, as shown in FIGS. 2–5, at least one upper dome-shaped cell portion 95 is provided. The upper cell portion 95 is formed from resilient material 26 and has an outer surface 100, an inner surface 116, an inner perimeter 105, an outer perimeter 110 and at least one upper opening portion 115. The upper opening portion 115 extends outwardly from the inner perimeter 105. At least one mating lower dome-shaped cell portion 120 is provided. The lower cell portion 120 is formed from resilient material 26 and has an outer surface 125, an inner surface 141, an inner perimeter 130, an outer perimeter 135 and at least one lower opening portion 140. The lower opening portion 140 extends outwardly from the inner perimeter 130. The upper cell portion 95 is joined to the mating lower cell portion 120 such that a hollow pressure cell 15 is formed. The cell 15 has at least one opening 35. A passageway 36 is provided. The passageway 36 has a first end 40 and a second end 45 and is attached to the at least one opening 35 at the first end 40 and extends outwardly as a connection 48 to either a passageway 36 of another cell 15 or a valve 50.

At least one reinforcing ring 55 is provided. The reinforcing ring 55 has an inner surface 60, an outer surface 65, an outer circumference 76, is formed of high-strength material 70 and is sized and shaped to fit tightly about the outer perimeter 30 of the pressure cell 15. The reinforcing ring 55 has an aperture 75. The aperture 75 extends from the inner surface 60 to the outer surface 65 and is sized, shaped and located to accommodate connection 48 of the passageway 36 to the pressure cell 15. A valving means 80 is provided. The valving means 80 is capable of controlling a flow of either a liquid or a gas through the passageway 36 and is attached to the second end 45 of the passageway 36.

Figure 2:
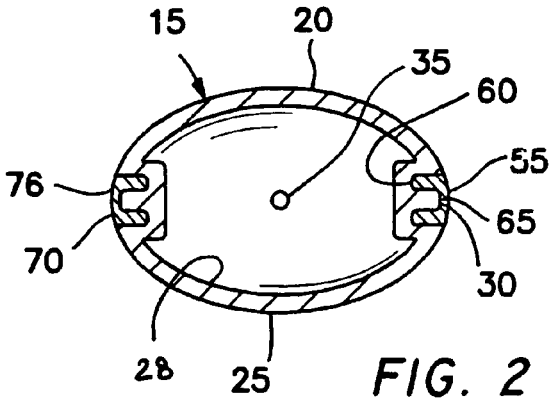
FIG. 2 is a cross-sectional view of the FIG. 1 embodiment taken along the line 2—2.
Figure 4:
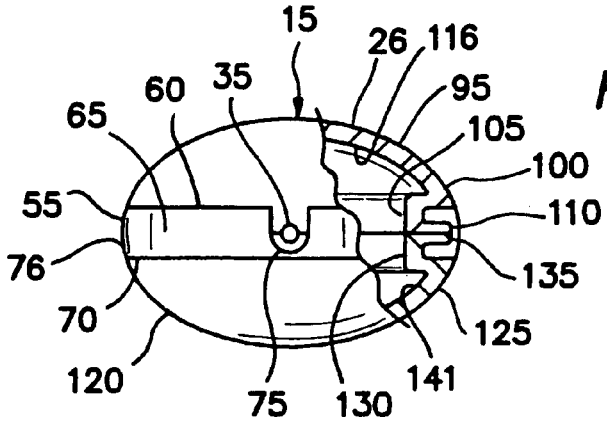
FIG. 4 is an end view and partial breakaway view of the partial cross-sectional view of the FIG. 1 embodiment illustrating a first embodiment retaining ring and passageway.

(3) In another variant of the invention, a shown in FIG. 2, a protruding rim 145 is provided. The protruding rim 145 is located at the outer perimeter 30 of the pressure cell 15. Upper 150 and lower 155 receiving notches are provided. The upper 150 and lower 155 receiving notches are located above and below the protruding rim 145. Upper 160 and lower 165 projecting ribs are provided. The upper 160 and lower 165 projecting ribs are located upon the inner surface 60 of the reinforcing ring 55. A central receiving notch 170 is provided. The central receiving notch 170 is located between the upper 160 and lower 165 projecting ribs. The projecting ribs 160, 165 are sized, shaped and located to fit the upper 150 and lower 155 receiving notches of the pressure cell 15. The central receiving notch 170 is sized, shaped and located to fit the protruding rim 145 of the pressure cell 15. When the reinforcing ring 55 is located about the outer perimeter 30 of the pressure cell 15, the pressure handling capacity of the cell 15 is increased.

Figure 5:
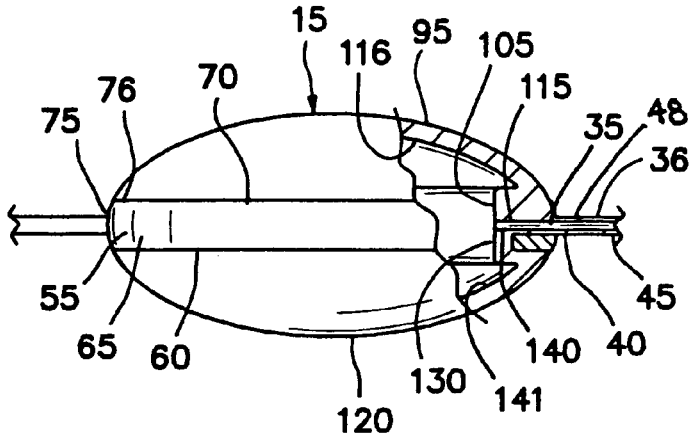
FIG. 5 is a side view and partial breakaway view of the partial cross-sectional view of the FIG. 1 embodiment illustrating the FIG. 4 retaining ring and passageway.
Figure 6:
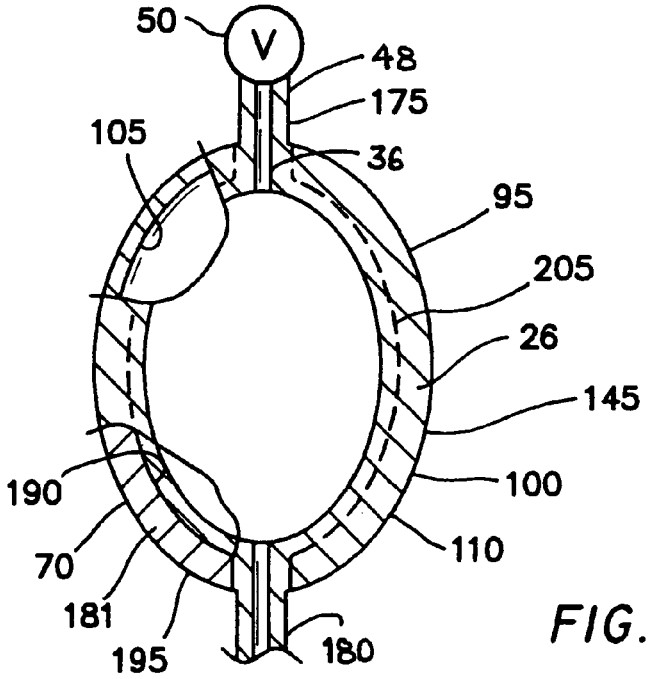
FIG. 6 is a partial cross-sectional plan view of the FIG. 9 embodiment illustrating the passageway portion of the upper dome-shaped cell portion and upper reinforcing ring.
Figure 6A:
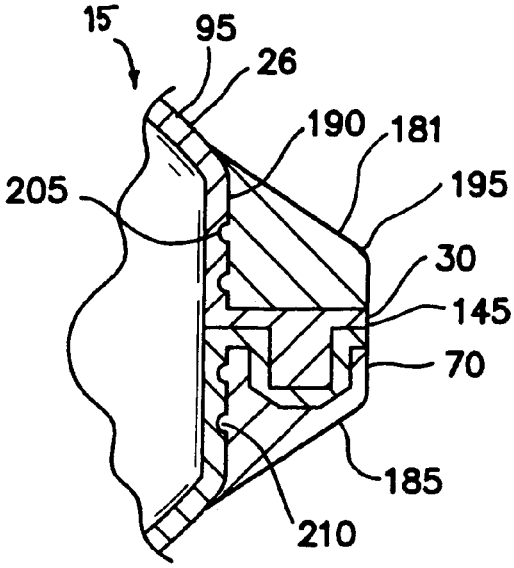
FIG. 6A is a cross-sectional view of the pressure vessel with second embodiment retaining rings.
Figure 9:
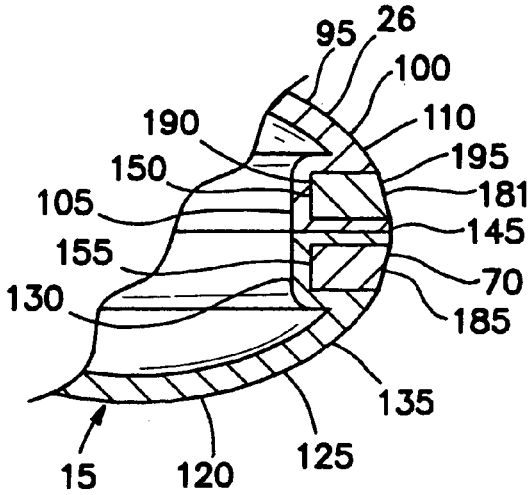
FIG. 9 is a partial cross-sectional view of the pressure vessel illustrating a fourth embodiment of the retaining rings.

(4) In another variant, as shown in FIGS. 5, 6 and 9, at least one upper dome-shaped cell portion 95 is provided. The upper cell portion 95 is formed from resilient material 26 and has an outer surface 100, an inner perimeter 105, an outer perimeter 110 and at least one upper passageway portion 175. The upper passageway portion 175 extends outwardly from the inner perimeter 105. At least one mating lower dome-shaped cell portion 120 is provided. The lower cell portion 120 is formed from resilient material 26 and has an outer surface 125, an inner perimeter 130, an outer perimeter 135 and at least one lower passageway portion 180. The lower passageway portion 180 extends outwardly from the inner perimeter 130. The upper cell portion 95 is joined to the mating lower cell portion 120 such that a hollow pressure cell 15 is formed. The cell 15 has at least one passageway 36 extending outwardly from the cell 15 as a connection 48 to either a passageway 36 of another cell 15 or a valve 50.

A protruding rim 145 is provided. The protruding rim 145 is located at the outer perimeter 30 of the pressure cell 15. Upper 150 and lower 155 receiving notches are provided. The upper 150 and lower 155 receiving notches are located above and below the protruding rim 145. Upper 181 and lower 185 reinforcing rings are provided. Each of the reinforcing rings 181, 185 has an inner surface 190, an outer surface 195, is formed of high-strength material 70 and is sized and shaped to fit tightly in either the upper 150 or lower 155 receiving notches. At least one of the reinforcing rings 181, 185 has an aperture 200. The aperture 200 extends from the inner surface 190 to the outer surface 195 and is sized, shaped and located to accommodate connection of the passageway 36 to the pressure cell 15. When the reinforcing rings 181, 185 are located about the outer perimeter 30 of the pressure cell 15, the pressure handling capacity of the cell 15 is increased.

Figure 10:
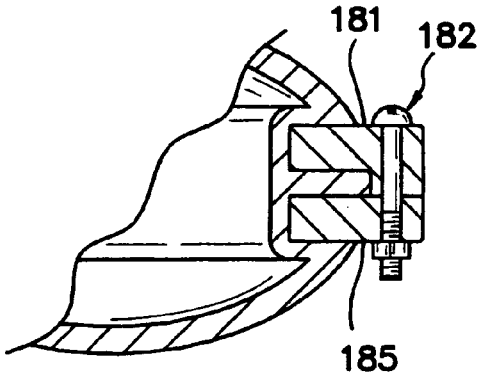
FIG. 10 is a partial cross-sectional view of the pressure vessel illustrating a fifth embodiment of the retaining rings including means for fastening the rings together.

(5) In yet a further variant of the invention, as shown in FIG. 10, means 182 are provided for fastening the upper reinforcing ring 181 to the lower reinforcing ring 185.

(6) In yet a further variant, as shown in FIGS. 4, 5, 6, 6A and 7A, at least one upper dome-shaped cell portion 95 is provided. The upper cell portion 95 is formed from resilient material 26 and has an outer surface 100, an inner perimeter 105, an outer perimeter 110 and at least one upper passageway 175 portion. The upper passageway portion 175 extends outwardly from the inner perimeter 105. At least one mating lower dome-shaped cell portion 120 is provided. The lower cell portion 120 is formed from resilient material 26 and has an outer surface 125, an inner perimeter 130, an outer perimeter 135 and at least one lower passageway portion 180. The lower passageway portion 180 extends outwardly from the inner perimeter 130.

The upper cell portion 95 is joined to the mating lower cell portion 120 such that a hollow pressure cell 15 is formed. The cell 15 has at least one passageway 36 extending outwardly from the cell 15 as a connection 48 to either a passageway 36 of another cell 15 or a valve 50. A protruding rim 145 is provided. The protruding rim 145 is located at the outer perimeter 30 of the pressure cell 15. At least one groove 205 located about the outer perimeter 30 above the protruding rim 145 is provided. Upper 181 and lower 185 reinforcing rings are provided. Each of the reinforcing rings 181, 185 has an inner surface 190, an outer surface 195, is formed of high-strength material 70 and is sized and shaped to fit tightly about the outer perimeter 30 on either side of the protruding rim 145.

The reinforcing rings 181, 185 have at least one rib 210 located upon the inner surface 190 thereof. The rib 210 is sized, shaped and located to engage the groove 205. When the reinforcing rings 181, 185 are located about the outer perimeter 30 of the pressure cell 15, the pressure handling capacity of the cell 15 is increased.

Figure 6B:
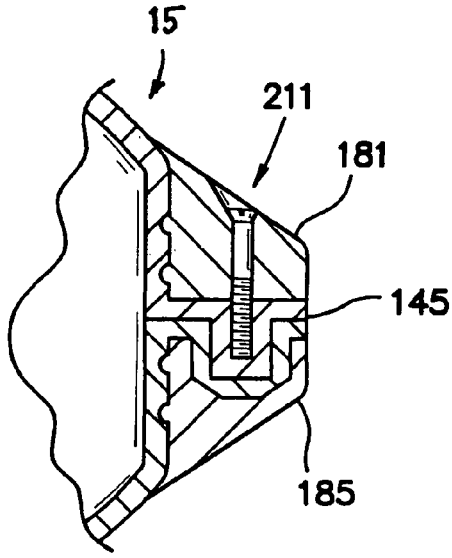
FIG. 6B is a cross-sectional view of the FIG. 6A pressure vessel with means for attaching the rings together.
Figure 7A:
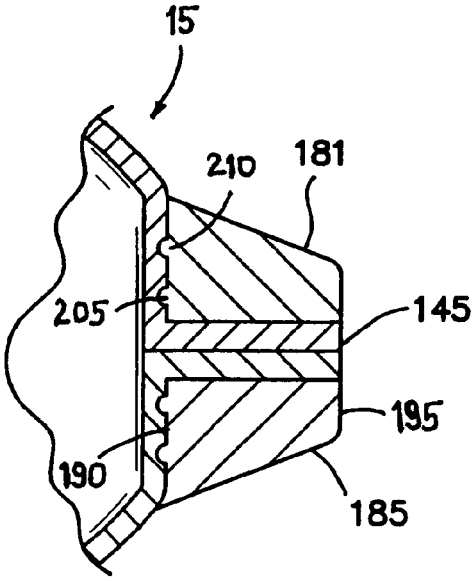
FIG. 7A is a cross-sectional view of the pressure vessel with third embodiment retaining rings.
Figure 7B:
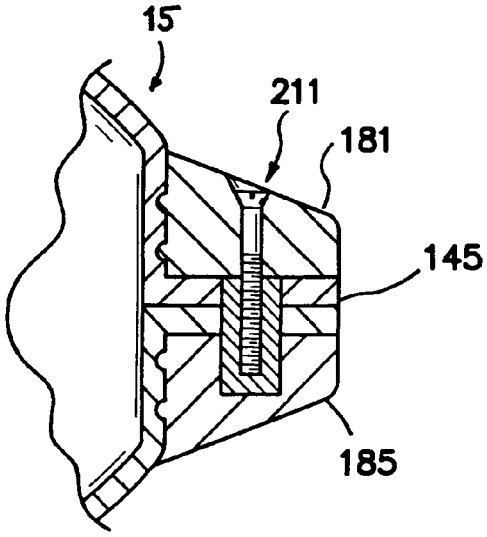
FIG. 7B is a cross-sectional view of the FIG. 7A pressure vessel with means for attaching the rings together.
Figure 8:
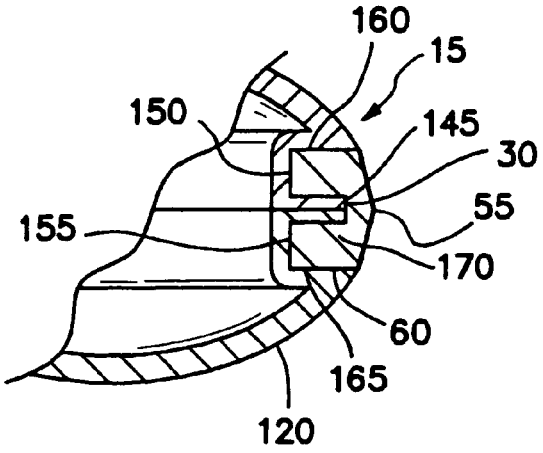
FIG. 8 is a partial cross-sectional view of the pressure vessel illustrating a third embodiment of the retaining ring.

(7) In still a further variant of the invention, as shown in FIG. 6B and 7B, means 211 are provided for fastening the upper reinforcing ring 181 to the lower reinforcing ring 185.

(8) In another variant of the invention, as shown in FIG. 12 and 14, an overwrapping layer 215 is provided. The overwrapping layer 215 is formed of high-strength braiding material 220 wound around the hollow pressure cell 15. When the hollow pressure cell 15 is overwrapped with high-strength braiding material 220, the pressure handling capacity of the pressure cell 15 is increased.

(9) In yet a further variant of the invention, as shown in FIG. 13, hoop winding 225 is provided. The hoop winding 225 is around the hollow pressure cell 15 to increase the pressure handling capacity of the pressure cell 15.

Figure 15:
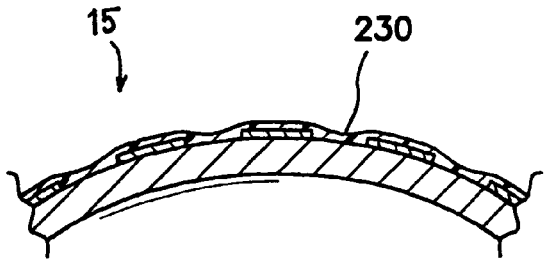
FIG. 15 is a partial cross-sectional view of the FIG. 13 embodiment illustrating a plastic coating.

(10) In still a further variant, as shown in FIG. 15, a plastic overcoating 230 is provided.

Figure 16:
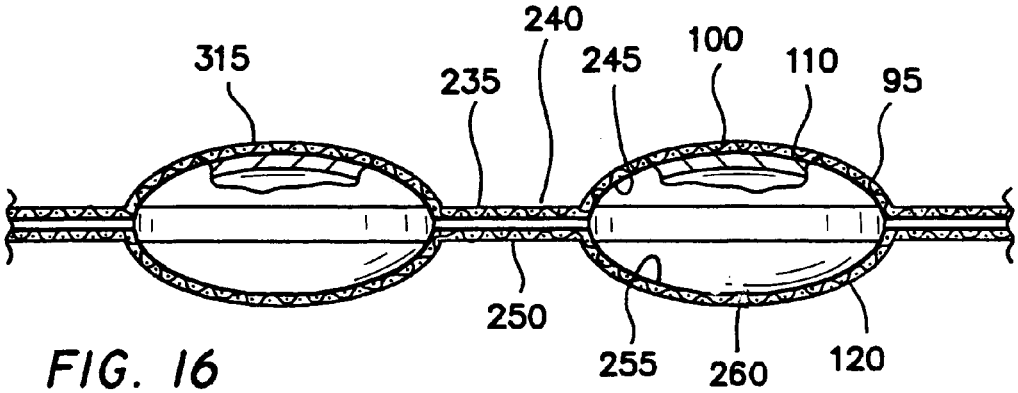
FIG. 16 is a side elevational view with partial cutaway illustrating a flexible blanket disposed over the cells.

(11) In yet a further variant, as shown in FIG. 16, a first flexible blanket 235 is provided. The first blanket 235 has an upper surface 240, a lower surface 245 and is sized and shaped to cover the upper cell portion 95 and extends outwardly beyond the outer perimeter 110. The first blanket 235 is fixedly attached at its lower surface 245 to the outer surface 100 of the upper cell portion 95. A second flexible blanket 250 is provided. The second blanket 250 has an upper surface 255, a lower surface 260 and is sized and shaped to cover the lower cell portion 120 and extends outwardly beyond the outer perimeter 135. The second blanket 250 is fixedly attached at its upper surface 255 to the outer surface 125 of the lower cell portion 120.

Figure 17:
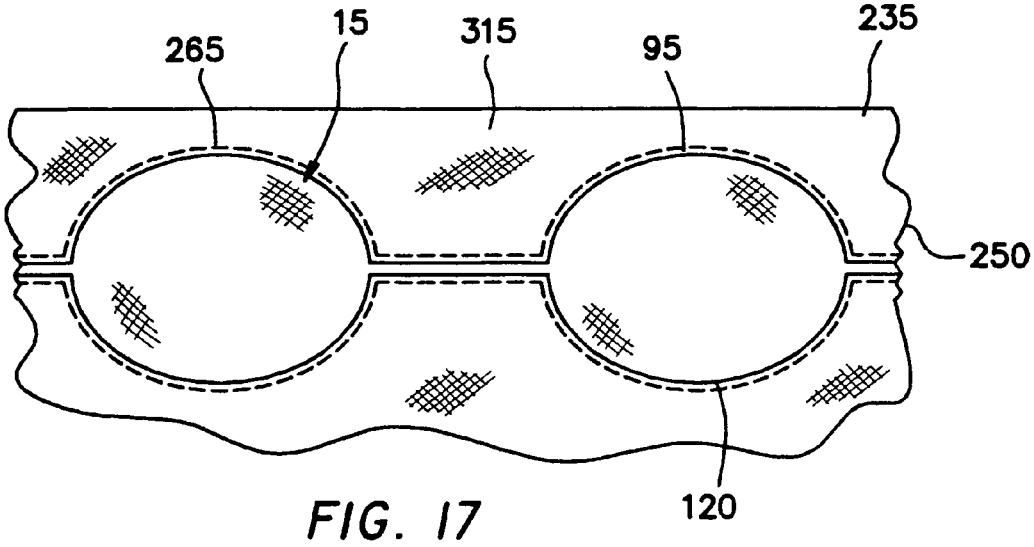
FIG. 17 is a plan view of the cells with flexible blanket illustrating heavy duty stitching for fastening the blankets over the cells.

(12) In another variant, as shown in FIG. 17, heavy duty stitching 265 is used to attach the first blanket 235 to the second blanket 250. The stitching 265 penetrates the first 235 and second 250 blankets between the cell portions 95, 120 and serves to further reinforce and increase the pressure-handling capabilities of the pressure cell 15.

(13) In another variant, the heavy duty stitching 265 is high pressure hoop and lock braiding 270.

Figure 18:
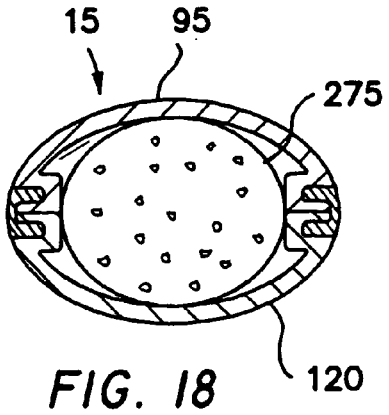
FIG. 18 is a cross-sectional view of the FIG. 1 embodiment including a cell-shaped sponge.

(14) In still a further variant of the invention, as shown in FIG. 18, a cell-shaped sponge 275 is inserted between the upper cell portion 95 and the lower cell portion 120 prior to joining the upper 95 and lower 120 cell portions. The sponge 275 serves to prevent the cell 15 from collapsing after either gas or liquid is removed from the cell 15.

Figure 19:
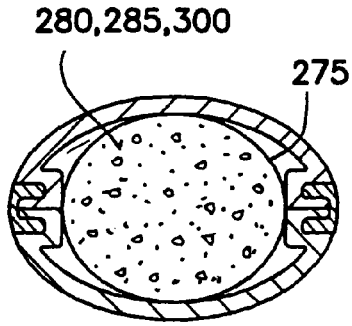
FIG. 19 is a cross-sectional view of the FIG. 1 embodiment including a cell-shaped sponge and zeolite compound.

(15) In another variant of the invention, as shown in FIG. 19, the sponge 275 is impregnated with a zeolite compound 280, a gas or liquid absorbing compound 285 or a reactive fuel cell compound 300.

Figure 20:
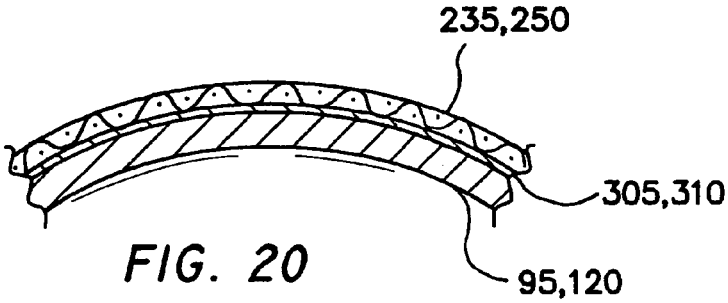
FIG. 20 is a partial cross-sectional view of the FIG. 16 embodiment illustrating a heat reflecting film between the cell and the flexible blanket.

(16) In still another further variant, as shown in FIG. 20, either a heat-reflecting plastic film 305 or a metal foil 310 is inserted between at least one of the first blanket 235 and the upper cell portion 95 or the second blanket 250 and the lower cell portion 120.

(17) In yet a another variant of the invention, the upper cell portion 95 is joined to the lower cell portion 120 by either radio frequency welding or high strength adhesive.

(18) In still a further variant, as shown in FIG. 16, either the first 235 and second 250 blankets are formed of high-strength fiber impregnated material 315.

(19) In still another variant of the invention, the passageway 36 has a cross-section of between 0.025 and 0.250 inches.

(20) In yet a further variant, as shown in FIGS. 21, 22, 22A, 23 and 23A an upper retaining plate 320 is provided. The upper retaining plate 320 has a third inner circumference 325, an outer circumference 330 and a third pre-determined thickness 335. The upper retaining plate 320 is sized and shaped to fit over the upper cell portion 95 and surround its outer perimeter 1when the upper cell portion 95 is covered by the first blanket 235. The third inner circumference 325 is larger than the outer circumference 76 of the reinforcing ring 55. A lower retaining plate 336 is provided. The lower retaining plate 336 has a fourth inner circumference 337, an outer circumference 338 and a fourth pre-determined thickness 350. The lower retaining plate 336 is sized and shaped to fit over the lower cell portion 120 and surround its outer perimeter 135 when the lower cell portion 120 is covered by the second blanket 250. The fourth inner circumference is larger than the outer circumference 76 of the reinforcing ring 55. Means 318 are provided for attaching the upper retaining plate 320 to the lower retaining plate 336. When the upper retaining plate 320 is attached to the lower retaining plate 336, surrounding the upper 95 and lower 120 cell portions and the first 235 and second 250 blankets covering the reinforcing ring 55, the pressure capacity of the cell 15 will be increased.

(21) In another variant, as shown in FIG. 21, 22, FIG. 22A and FIG. 23, means 318 are provided for attaching the upper retaining plate 320 to the lower retaining plate 336. A series of holes 360 are provided. The holes 360 penetrate the upper retaining plate 320 between its outer circumference 330 and the third inner circumference 325. The holes 360 also penetrate the lower retaining plate 336 between its outer circumference 338 and the fourth inner circumference 337, the first blanket 235, a border of sheet material 236 surrounding the outer perimeter 110 of the upper cell portion 95, a border of sheet material 237 surrounding the outer perimeter 135 of the lower cell portion 120 and the second blanket 250. The holes 360 are outside of the outer circumference 76 of the reinforcing ring 55. A series of fastening means 365 is provided. The fastening means 365 are sized and shaped to pass through the series of holes 360 and are capable of securing the upper retaining plate 320 to the lower retaining plate 336.

Figure 22:
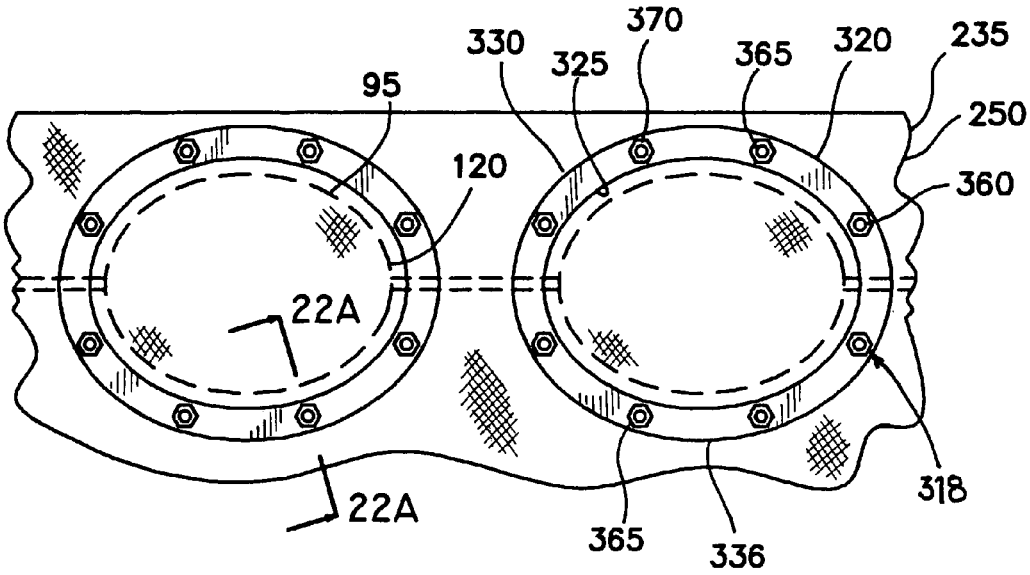
FIG. 22 is a plan view of the FIG. 21 embodiment including nut and bolt fasteners.
Figure 22A:
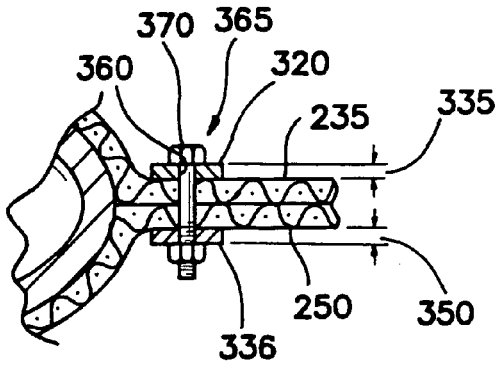
FIG. 22A is a cross-sectional side view of the FIG. 22 embodiment.

(22) In yet a further variant of the invention, as shown in FIG. 22 and FIG. 22A, the fastening means 365 is a series of bolt and locking nuts 370.

Figure 23:
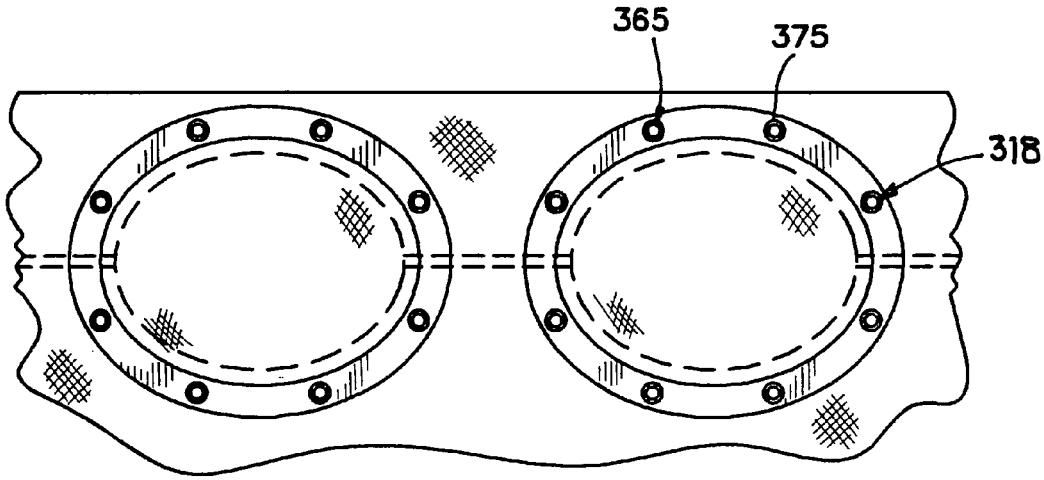
FIG. 23 is a plan view of the FIG. 21 embodiment including rivet fasteners.

(23) In another variant of the invention, as shown in FIG. 23, the fastening means 365 is a series of rivets 375.

Figure 21:
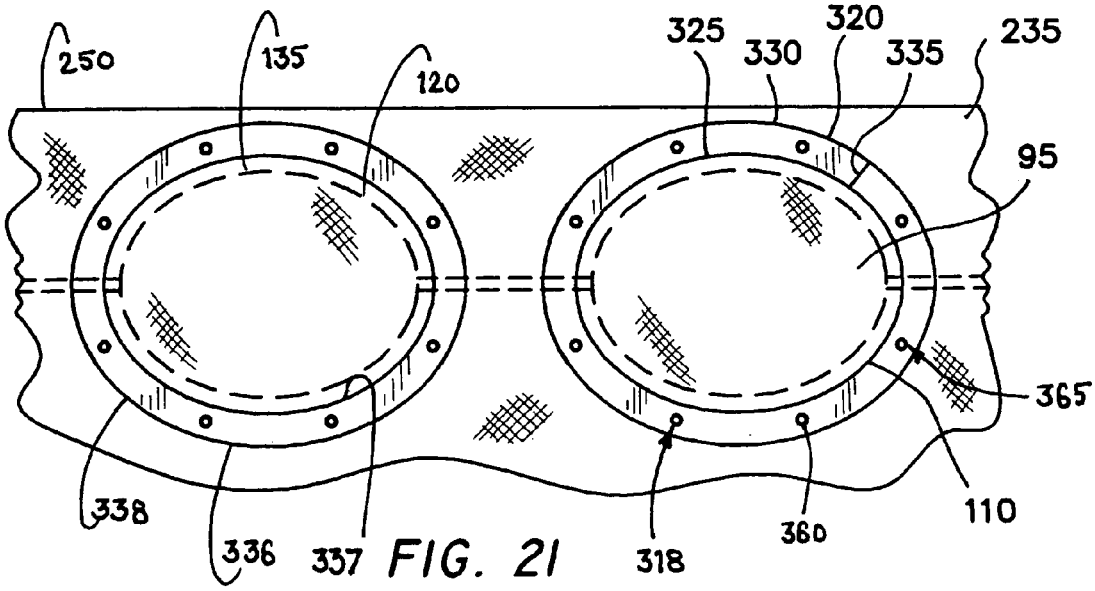
FIG. 21 is a plan view of the FIG. 1 embodiment including retaining plates.
Figure 23A:
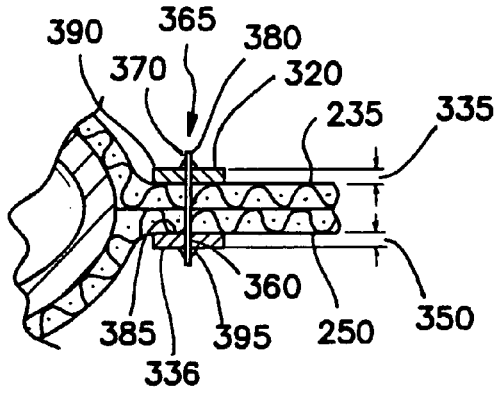
FIG. 23A is a cross-sectional side view of the FIG. 23 embodiment.

(24) In still a further variant, as shown in FIGS. 21 and 23A, the means 318 for attaching the upper retaining plate 320 to the lower retaining plate 336 further includes a series of holes 360. The holes 360 penetrate the upper retaining plate 320 between its outer circumference 330 and the third inner circumference 325, the first blanket 235, a border of sheet material 236 surrounding the outer perimeter 110 of the upper cell portion 95, a border of sheet material 237 surrounding the outer perimeter 135 of the lower cell portion 120 and the second blanket 250. The holes 360 are outside of the outer circumference 76 of the reinforcing ring 55. A series of pins 380 are provided. The pins 380 are affixed orthogonally along an upper surface 385 of the lower retaining plate 336 and are sized, shaped and located to fit slidably through the series of holes 360 and extends slightly above an upper surface 390 of the upper retaining plate 320. A series of welds 395 are provided. The welds 395 fixedly attach the pins 380 to the upper retaining plate 320, thereby securing the upper 320 and lower 335 retaining plates to each other.

Figure 24:
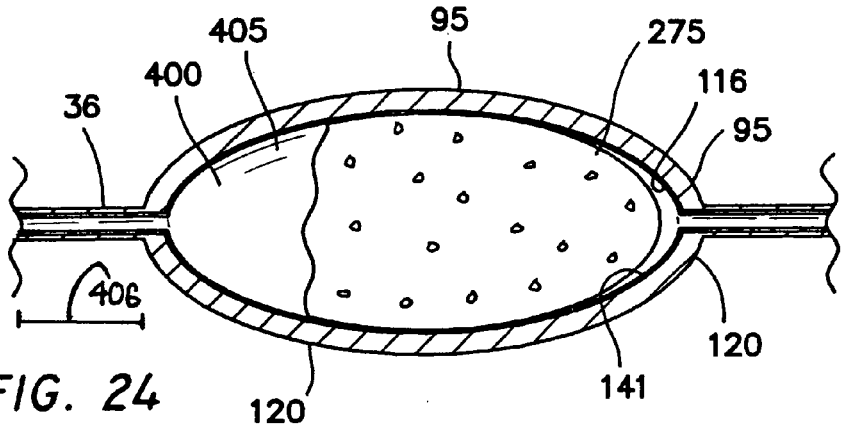
FIG. 24 is a side cross-sectional view of FIG. 18 embodiment including a flexible tube encasing the sponge.

(25) In yet a further variant of the invention, as shown in FIG. 24, a series of cell shaped sponges 275 are provided. A tube 400 is provided. The tube 400 is formed of flexible gas and liquid impervious material 405 and is sized and shaped to surround the sponges 275. The sponges 275 are inserted in the tube 400 at spaced intervals 406. The encased sponges 275 are inserted between the upper cell portions 95 and the lower cell portions 120 prior to joining the upper 95 and lower 120 cell portions. The tube 400 extends through the passageways 36. The sponges 275 serve to prevent the cells 15 from collapsing after either gas or liquid is removed from the cells 15. The tube 400 serves to prevent contamination of either gas or liquid by the inner surfaces 116, 141 of the upper 95 and lower 120 cell portions.

Figure 25:
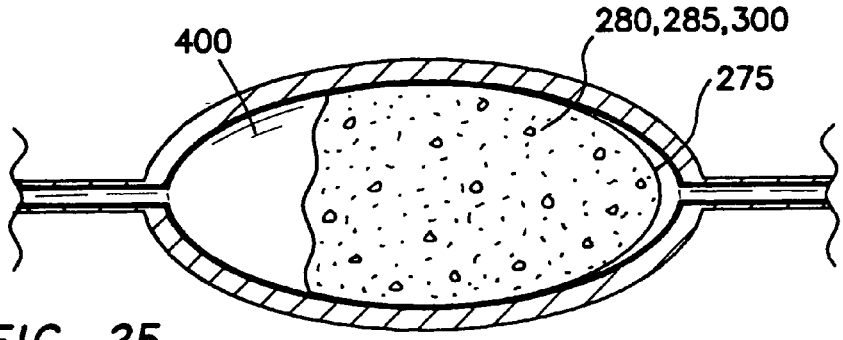
FIG. 25 is a side cross-sectional view of FIG. 24 embodiment including a zeolite compound impregnated in the sponge.
Figure 26:
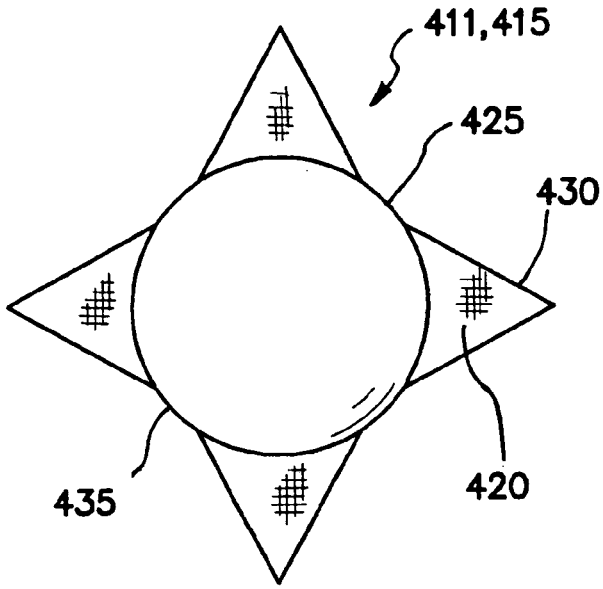
FIG. 26 is a plan view of a first embodiment of a reinforcing panel for the FIG. 1 embodiment.
Figure 27:
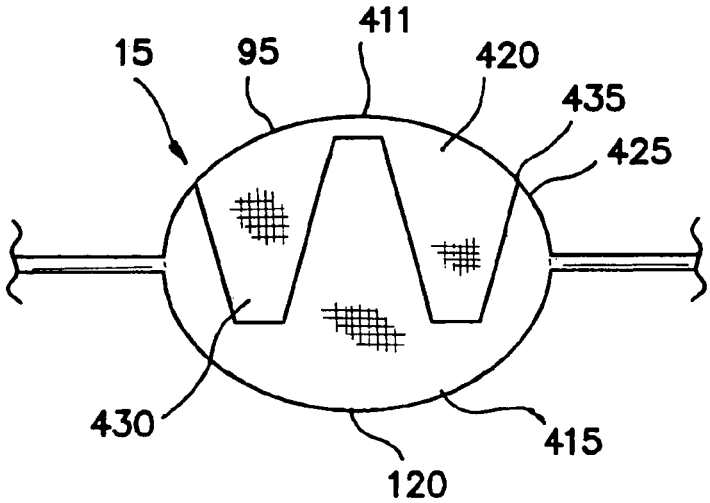
FIG. 27 illustrates upper and lower FIG. 26 reinforcing panels attached to the FIG. 1 embodiment.
Figure 28:
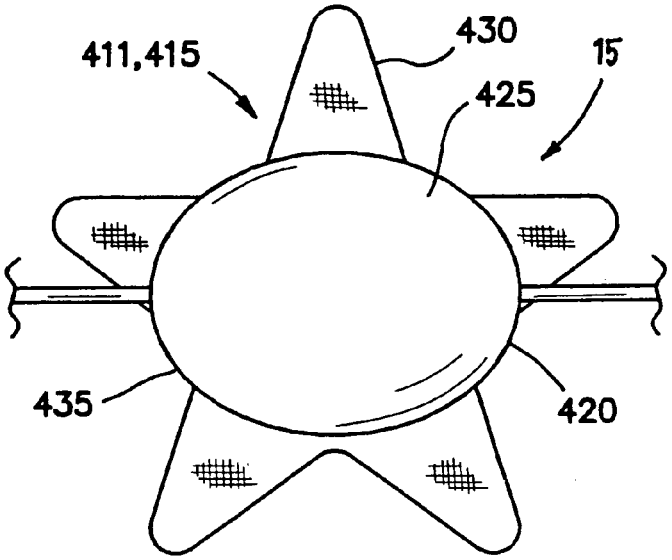
FIG. 28 is a plan view of a second embodiment reinforcing panel.
Figure 29:
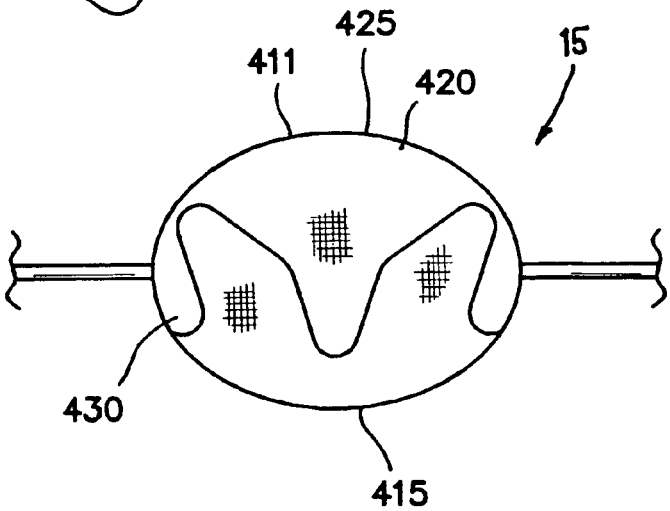
FIG. 29 illustrates upper and lower FIG. 28 reinforcing panels attached to the FIG. 1 embodiment.

(26) In another variant of the invention, as shown in FIG. 25, the sponges 275 are impregnated with a zeolite compound 280, a gas or liquid absorbing compound 285 or a reactive fuel cell compound 300.

(27) In another variant, as shown in FIGS. 24 and 25, the tube 400 is formed from material selected from the group comprising: thermoplastic polyurethane elastomer, polyurethane polyvinyl chloride, polyvinyl chloride, thermoplastic elastomer, Teflon® and polyethylene.

(28) In still a further variant of the invention, as shown in FIGS. 26–30, upper 411 and lower 415 reinforcing panels are provided. The reinforcing panels 411, 415 are formed of high-strength woven material 420 and are substantially ovoid 425 in shape with extensions 430 projecting from a perimeter 435 of the ovoid shape 425. The reinforcing panels 411, 415 are adhered to the outer surfaces 100, 125 of the upper 95 and lower 120 cell portions of the hollow pressure cell 15, thereby increasing the pressure handling capabilities of the pressure cell 15.

(29) In another variant of the invention, the method of adhesion is selected from the group comprising: high-strength adhesive, sonic welding, and RF welding.

Figure 30:
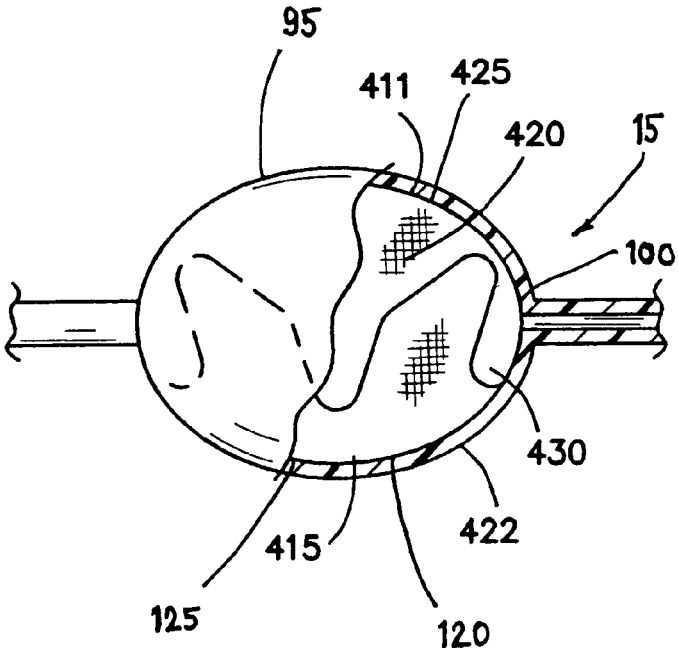
FIG. 30 is a partial cross-sectional view of the FIG. 29 embodiment illustrating a plastic coating.
Figure 31:
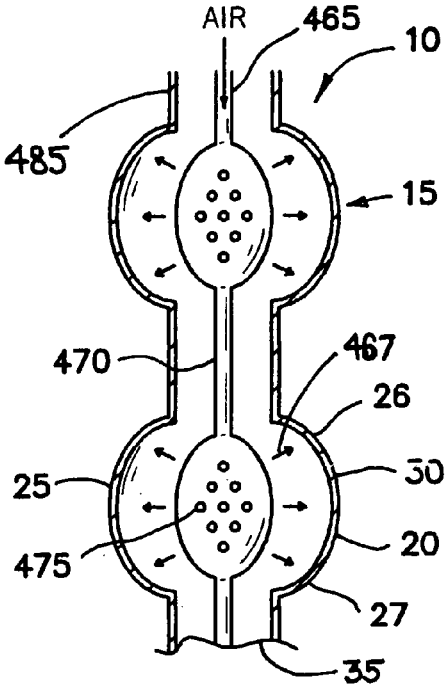
FIG. 31 is a cross-sectional view of an apparatus for forming a seamless pressure cells using a blow-molding technique and an internal core form.
Figure 32:
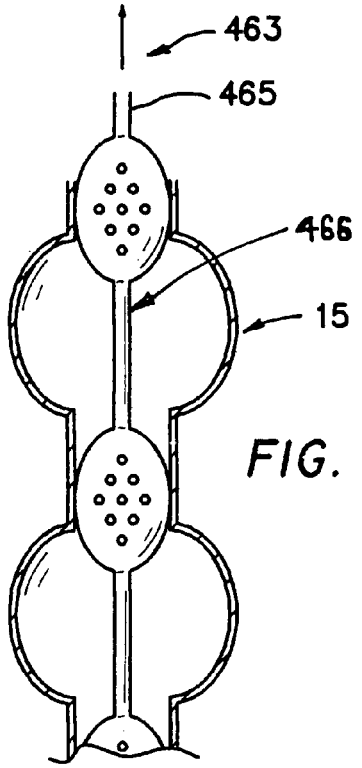
FIG. 32 is a cross-sectional view of an apparatus for forming a seamless pressure cell using a blow-molding technique illustrating removal of the internal core form from the cells.
Figure 33:
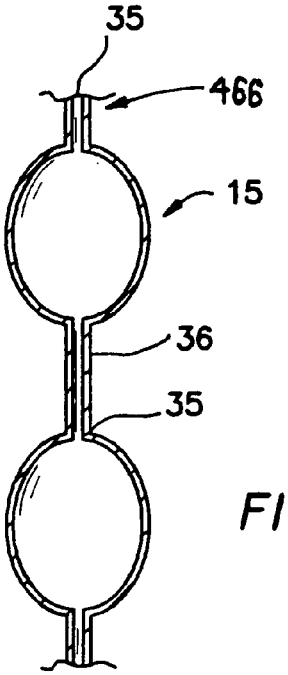
FIG. 33 is a cross-sectional view of the pressure cells after removal of the internal core form.
Figure 34:
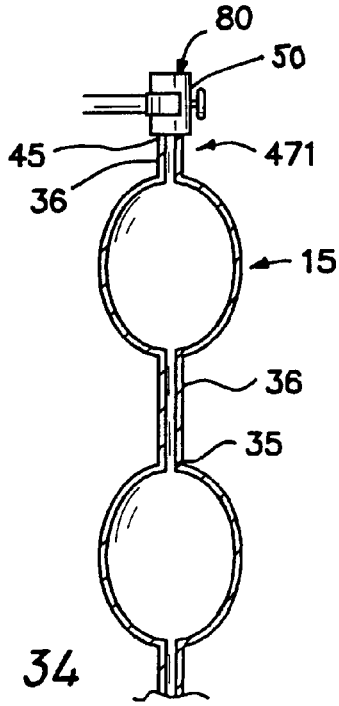
FIG. 34 is a cross-sectional view of an apparatus for forming a seamless pressure cell illustrating the introduction of pressure into the cells.
Figure 38:
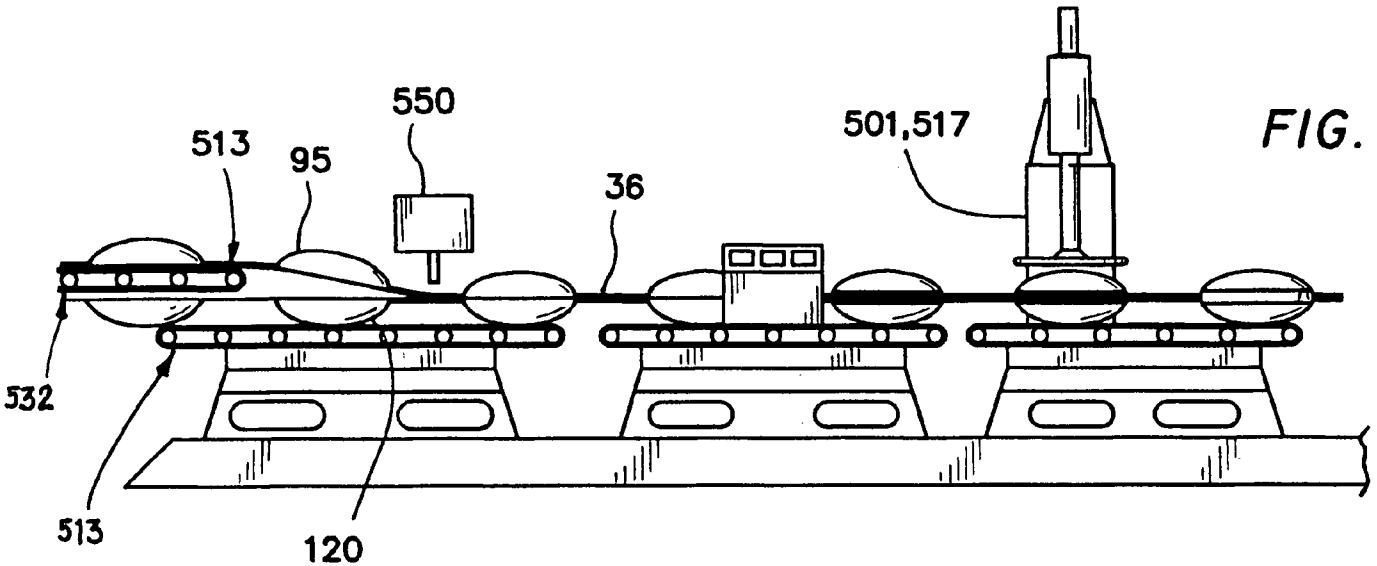
FIG. 38 is a side elevational view of an apparatus for forming a flexible pressure vessel cell by thermal die stamping illustrating attachment of reinforcing rings.

(30) In another variant, as shown in FIG. 30, the woven material 420 is prepregnated with either adhesive or laminating material 422 and subjected to heat and pressure.

(31) In yet a further variant of the invention, as shown in FIGS. 27–30, the passageway 36 is removably attached to the hollow pressure cell 15.

(32) In another variant of the invention, as shown in FIG. 11, the passageway 36 is removably attached to the hollow pressure cell 15 by a threaded fitting 440. The threaded fitting 440 is sized and shaped to fit a threaded opening 445 at the outer perimeter 30 of the hollow pressure cell 15.

Figure 11A:
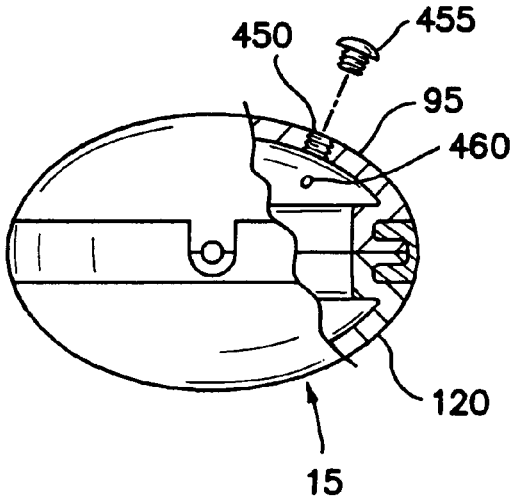
FIG. 11 is a plan view of a pressure vessel having removable passageways.

(33) In still a further variant of the invention, as shown in FIG. 11A, an orifice 450 is provided. The orifice 450 penetrates either the upper 95 or lower 120 cell portions. A removable plug 455 is provided. The removable plug 455 is sized and shaped to fit sealably into the orifice 450, thereby permitting introduction of material 460 into the pressure cell 15.

(34) An apparatus for fabricating an ovoid flexible pressure vessel 10, as shown in FIGS. 4, 31–34 and 38, may be constructed from the following components. An internal core form 465 is provided. The internal core form 465 has the internal shape of a hollow pressure cell 15, an internal passageway 470 and a plurality of outlet blow holes 475 connected to the passageway 470. An open top vessel (not shown) is provided. The vessel contains a solution of liquid plastic 485. Means (not shown) are provided for moving the internal core form 465 into and out of the solution 485. Means 467 are provided for pumping either pressurized gas or liquid into the passageway 470, thereby causing the liquid plastic 485 to expand about the internal core form 465 to form a hollow pressure cell 15. The pressure cell 15 has symmetrical upper 20 and lower 25 cell portions, is formed of resilient material 26 and has an outer surface 27, an outer perimeter 30 and at least one opening 35 located at the outer perimeter 30. Means 463 are provided for extracting the internal core form 465 from the hollow pressure cell 15. Means 466 are provided for connecting a passageway 36 to the at least one opening 35 for connection to either a passageway 36 of another cell 15 or a valve 50. Means 501 are provided for pressing a reinforcing ring 55 onto the outer perimeter 30. The reinforcing ring 55 has an inner surface 60, an outer surface 65, is formed of high-strength material 70 and is sized and shaped to fit tightly about the outer perimeter 30 of the pressure cell 15. The reinforcing ring 55 has an aperture 75. The aperture 75 extends from the inner surface 60 to the outer surface 65 and is sized, shaped and located to accommodate connection of the passageway 36 to the pressure cell 15. Means 471 are provided for attaching a valving means 80 to the passageway 36. The valving means 80 is capable of controlling a flow of either a liquid or a gas through the passageway 36 and is attached to the second end 45 of the passageway 36. When the reinforcing ring 55 is located about the outer perimeter 30 of the pressure cell 15, the pressure handling capacity of the cell 15 is increased.

Figure 43:
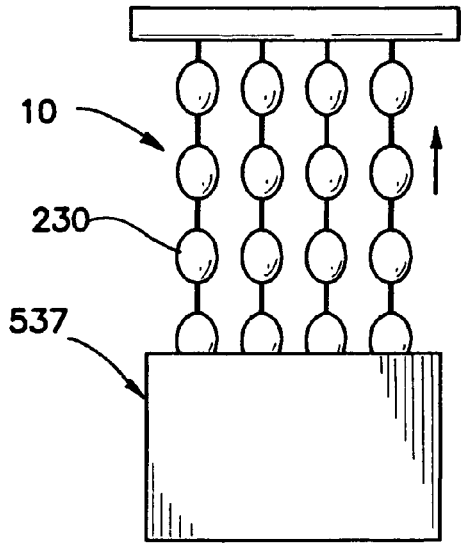
FIG. 43 is a side elevational view of an apparatus for forming a protruding rim and receiving notches on the pressure cell.

(35) In a variant of the apparatus for fabricating an ovoid flexible pressure vessel 10, as shown in FIG. 43, means 473 are provided for forming a protruding rim 145 at an outer perimeter 30 of the hollow pressure cell 15. The protruding rim 145 has upper 150 and lower 155 receiving notches located above and below the protruding rim 145. The reinforcing ring 55 has an outer surface 65, an inner surface 60, upper 160 and lower 165 projecting ribs and a central receiving notch 170 located between the upper 160 and lower 165 projecting ribs. The projecting ribs 160, 165 are sized, shape and located to fit the upper 150 and lower 155 receiving notches of the pressure cell 15. The central receiving notch 170 is sized, shaped and located to fit the protruding rim 145 of the pressure cell 15.

(36) In yet a further variant of the apparatus for fabricating an ovoid flexible pressure vessel 10, as shown in FIGS. 4, 34, 35 and 38, first 490 and second 495 symmetrical external mold portions are provided. Each of the mold portions 490, 495 has at least one cavity 500 reflecting the external shape of a hollow pressure cell 15 and a connecting internal passageway 36. The cavity 500 has at least one vacuum passage 505 connecting to an external vacuum source 510. First 515 and second 520 sheets of moldable thermoplastic material are provided. Means 512 are provided for inserting the sheets of thermoplastic material 515, 520 between the mold portions 490, 495. Means 522 are provided for heating the mold portions 490, 495 and the sheets 515, 520. Means 523 are provided for applying vacuum to the vacuum passages 505, thereby forming a hollow pressure cell 15. Means (not shown) are provided for removing the hollow pressure cell 15 from the mold portions 490, 495. Means 501 are provided for pressing a reinforcing ring 55 onto the outer perimeter 30. The reinforcing ring 55 has an inner surface 60, an outer surface 65, is formed of high-strength material 70 and is sized and shaped to fit tightly about the outer perimeter 30 of the pressure cell 15. The reinforcing ring 55 has an aperture 75. The aperture 75 extends from the inner surface 60 to the outer surface 65 and is sized, shaped and located to accommodate connection of the passageway 36 to the pressure cell 15. Means 471 are provided for attaching a valving means 80 to the passageway 36. The valving means 80 is capable of controlling a flow of either a liquid or a gas through the passageway 36 and is attached to the second end 45 of the passageway 36. When the reinforcing ring 55 is located about the outer perimeter 30 of the pressure cell 15, the pressure handling capacity of the cell 15 is increased.

(37) In another variant of the apparatus for fabricating an ovoid flexible pressure vessel 10, as shown in FIG. 43, means 473 are provided for forming a protruding rim 145 at an outer perimeter 30 of the hollow pressure cell 15. The protruding rim 145 has upper 150 and lower 155 receiving notches located above and below the protruding rim 145. The reinforcing ring 55 has an outer surface 65, an inner surface 60, upper 160 and lower 165 projecting ribs and a central receiving notch 170 located between the upper 160 and lower 165 projecting ribs. The projecting ribs 160, 165 are sized, shaped and located to fit the upper 150 and lower 155 receiving notches of the pressure cell 15. The central receiving notch 170 is sized, shaped and located to fit the protruding rim 145 of the pressure cell 15.

(38) In still a further variant of the apparatus for fabricating an ovoid flexible pressure vessel 10, as shown in FIGS. 34, 36–38, first 490 and second 495 symmetrical external mold portions are provided. Each of the mold portions 490, 495 has at least one cavity 500 reflecting the external shape of a hollow pressure cell 15 and a connecting internal passageway 36. Means 524 are provided for extruding a plastic tube 525 between the mold portions 490, 495 and pressurizing the plastic tube 525 to form the hollow pressure cell 15 with attached connecting internal passageway 36. Means (not shown) are provided for removing the hollow pressure cell 15 with attached passageway 36 from the mold portions 490, 495. Means 466 are provided for connecting a passageway 36 to the at least one opening 35 for connection to either a passageway 36 of another cell 15 or a valve 50. Means 501 are provided for pressing a reinforcing ring 55 onto the outer perimeter 30. The reinforcing ring 55 has an inner surface 60, an outer surface 65, is formed of high-strength material 70 and is sized and shaped to fit tightly about the outer perimeter 30 of the pressure cell 15. The reinforcing ring 55 has an aperture 75. The aperture 75 extends from the inner surface 60 to the outer surface 65 and is sized, shaped and located to accommodate connection of the passageway 36 to the pressure cell 15. Means are provided for attaching a valving means 80 to the passageway 36. The valving means 80 is capable of controlling a flow of either a liquid or a gas through the passageway 36 and is attached to the second end 45 of the passageway 36. When the reinforcing ring 55 is located about the outer perimeter 30 of the pressure cell 15, the pressure handling capacity of the cell 15 is increased.

(39) In yet a further variant of the apparatus for fabricating an ovoid flexible pressure vessel 10, as shown in FIG. 43, means 473 are provided for forming a protruding rim 145 at an outer perimeter 30 of the hollow pressure cell 15. The protruding rim 145 has upper 150 and lower 155 receiving notches located above and below the protruding rim 145. The reinforcing ring 55 has an outer surface 65, an inner surface 60, upper 160 and lower 165 projecting ribs and a central receiving notch 170 located between the upper 160 and lower 165 projecting ribs. The projecting ribs 160, 165 are sized, shaped and located to fit the upper 150 and lower 155 receiving notches of the pressure cell 15. The central receiving notch 170 is sized, shaped and located to fit the protruding rim 145 of the pressure cell 15.

(40) In still a further variant of the apparatus for fabricating an ovoid flexible pressure vessel 10, as shown in FIGS. 9, 34, 38 and 41, first 530 and second 531 rolls of planar resilient material 26 are provided. First 540 and second 541 thermal die stamping stations are provided. The stamping stations 540, 541 are capable of forming upper 95 and lower 120 cell portions of a hollow pressure cell 15 and a connecting internal passageway 36. Means 532 are provided for moving resilient material 26 from the first 530 and second 531 rolls of planar resilient material into the first 540 and second 541 thermal die stamping stations. A radio frequency welder 550 is provided. The welder 550 is capable of joining the upper cell portion 95 to the lower cell portion 120. Means 513 are provided for moving the upper 95 and lower 120 cell portions into the radio frequency welder, thereby joining the upper 95 and lower cell 120 portions and forming the internal connecting passageway 36. Means 517 are provided for pressing upper 181 and lower 185 reinforcing rings onto the hollow pressure cell 15 adjacent the outer perimeter 30. The reinforcing rings 181, 185 have an inner surface 190, an outer surface 195, are formed of high-strength material 70 and are sized and shaped to fit tightly about the outer perimeter 30 of the pressure cell 15. At least one of the reinforcing rings 181, 185 has an aperture 200. The aperture 200 extends from the inner surface 190 to the outer surface 195 and is sized, shaped and located to accommodate connection of the passageway 36 to the pressure cell 15. Means 471 are provided for attaching a valving means 80 to the passageway 36. The valving means 80 is capable of controlling a flow of either a liquid or a gas through the passageway 36 and is attached to the second end 45 of the passageway 36. When the reinforcing rings 181, 185 are located about the outer perimeter 30 of the pressure cell 15, the pressure handling capacity of the cell 15 is increased.

(41) In yet a further variant of the apparatus for fabricating an ovoid flexible pressure vessel 10, as shown in FIGS. 6A, 7A, 9 and 43, means are provided for forming a protruding rim 145 at an outer perimeter 30 of the hollow pressure cell 15. Means (not shown) are provided for forming at least one groove 205 located about the outer perimeter 30 above the protruding rim 145. Means are provided for forming at least one groove 205 located about the outer perimeter 30 below the protruding rim 145. Each of the upper 181 and lower 185 reinforcing rings has an inner surface 190, an outer surface 195, is formed of high-strength material 70 and is sized and shaped to fit tightly about the outer perimeter 30 on either side of the protruding rim 145. The reinforcing rings 181, 185 have at least one rib 210 located upon the inner surface 190 thereof. The rib 210 is sized, shaped and located to engage the groove 205.

(42) In another variant of the apparatus for fabricating an ovoid flexible pressure vessel 10, as shown in FIG. 10, means 182 are provided for fastening the upper reinforcing ring 181 to the lower reinforcing ring 185.

Figure 42:
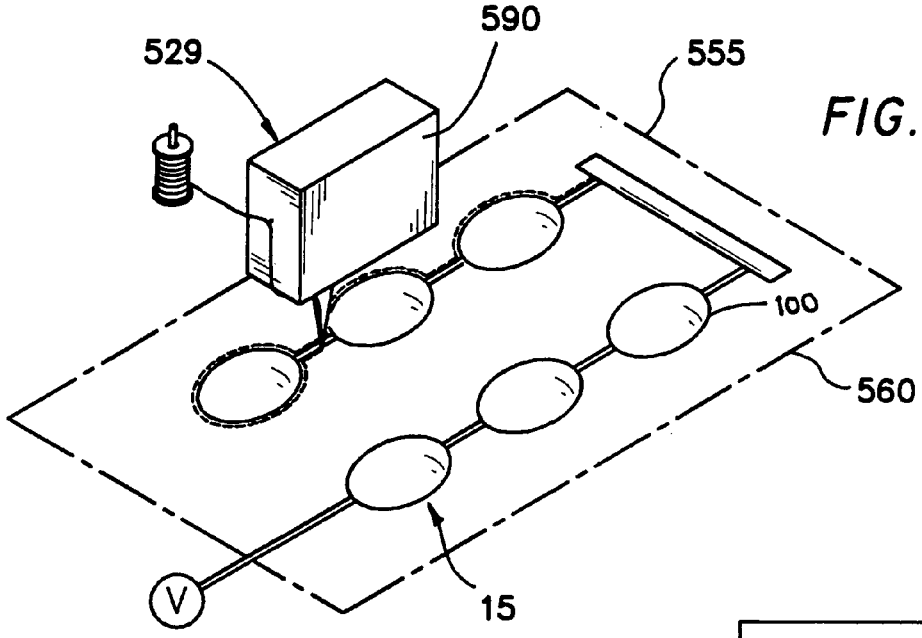
FIG. 42 is a perspective view of an apparatus for stitching the flexible blankets together over the pressure cells.

(43) In yet a further variant of the apparatus for fabricating an ovoid flexible pressure vessel 10, as shown in FIG. 42, first 555 and second 560 rolls of high-strength fiber impregnated blanket material are provided. Means 529 are provided for attaching the first 555 and second 560 blankets over upper 100 and lower 125 surfaces of the hollow pressure cell 15.

Figure 40:
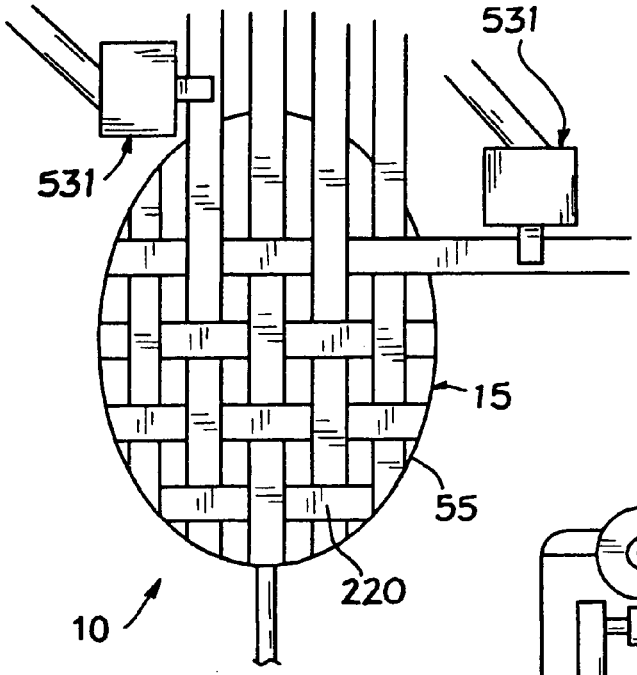
FIG. 40 is a plan view of an apparatus for overwrapping the hollow pressure cell and reinforcing ring with high-strength braiding material.
Figure 40A:
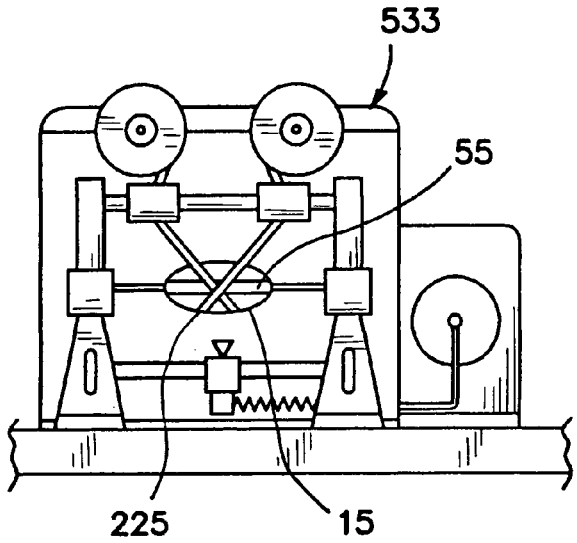
FIG. 40A is a side elevational view of an apparatus for hoop winding the pressure vessel.
Figure 41:
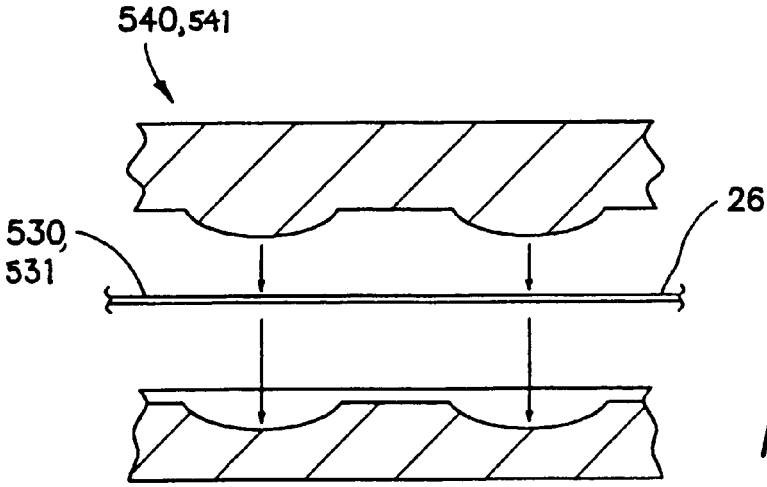
FIG. 41 is a side elevational view of an apparatus for forming a flexible pressure vessel cell by thermal die stamping.

(44) In still a further variant of the apparatus for fabricating an ovoid flexible pressure vessel 10, as shown in FIG. 40, means 531 are provided for overwrapping the hollow pressure cell 15 and reinforcing ring 55 with high-strength braiding material 220, thereby increasing the pressure handling capability of the hollow pressure cell 15.

(45) In yet a further variant of the apparatus for fabricating an ovoid flexible pressure vessel 10, as shown in FIG. 40 A, means 533 are provided for hoop winding 225 the hollow pressure cell 15 and reinforcing ring 55, thereby increasing the pressure handling capacity of the pressure cell 15.

Figure 48:
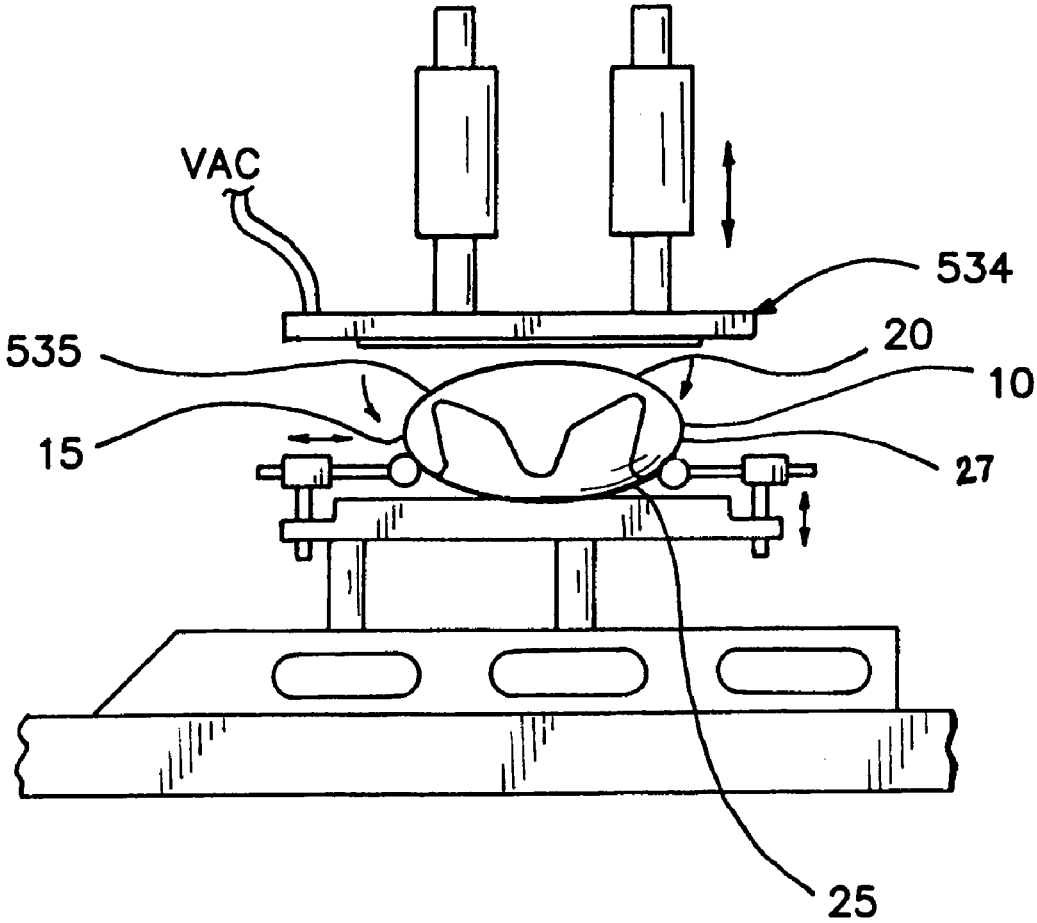
FIG. 48 is a side elevational view of an apparatus for attaching upper and lower retaining plates to the pressure cells.

(46) In another variant, as shown in FIG. 48, the apparatus for fabricating an ovoid flexible pressure vessel 10 has a means 534 for adhering reinforcing panels 535 to an outer surface 27 of the upper 20 and lower 25 cell portions of a hollow pressure cell 15, thereby increasing the pressure handling capabilities of the pressure cell 15.

Figure 44:
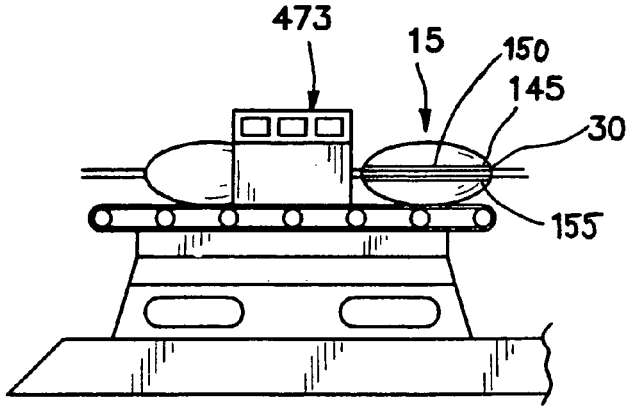
FIG. 44 is a side elevational view of an apparatus for applying plastic coating the pressure vessels.

(47, 48, 49) In an additional variant of the apparatus for fabricating an ovoid flexible pressure vessel 10, as shown in FIG. 44, means 537 are provided for applying a plastic overcoating 230.

Figure 45:
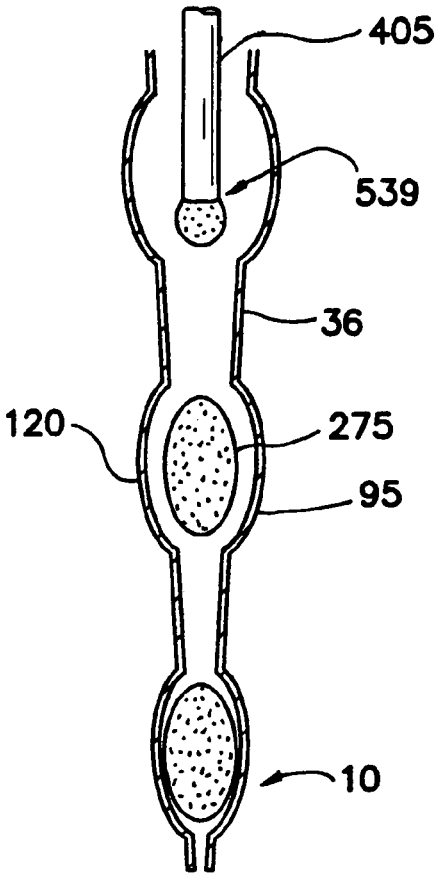
FIG. 45 is a cross-sectional view of an apparatus for inserting cell-shaped sponges into the pressure cells.

(50) In still a further variant of the apparatus for fabricating an ovoid flexible pressure vessel 10, as shown in FIG. 45, a series of cell-shaped sponges 275 are provided. Means 539 are provided for inserting the cell-shaped sponges 275 between the upper 95 and lower 120 cell portions prior to joining the upper 95 and lower 120 cell portions.

Figure 39:
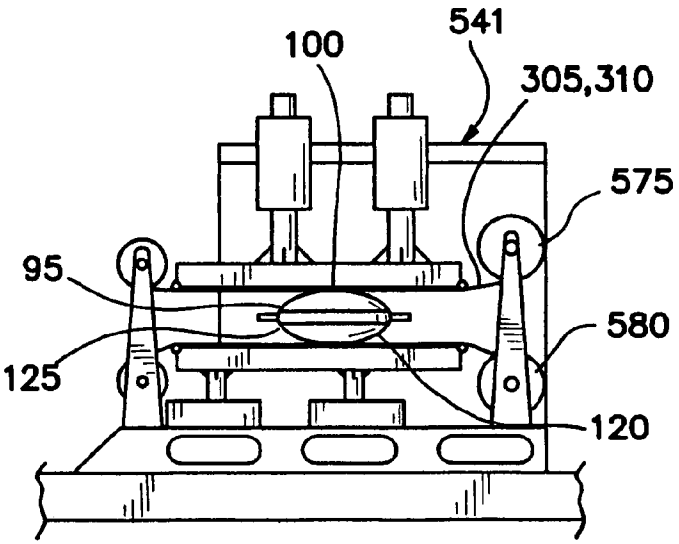
FIG. 39 is a side elevational view of an apparatus for attaching high-strength fiber impregnated blankets over the pressure cells.

(51) In yet a further variant of the apparatus for fabricating an ovoid flexible pressure vessel 10, as shown in FIG. 39, first 575 and second 580 rolls of either heat-reflecting plastic film 305 or metal foil 310 are provided. Means 541 are provided for attaching either heat-reflecting plastic film 305 or metal foil 310 to the outer surface 100, 125 of at least one of the upper cell portion 95 and the lower cell portion 120.

(52) In still a further variant of the apparatus for fabricating an ovoid flexible pressure vessel 10, as shown in FIG. 42, means (not shown) are provided for moving blanketed cells 15 to a high-pressure hoop and lock braiding machine 590.

Figure 46:
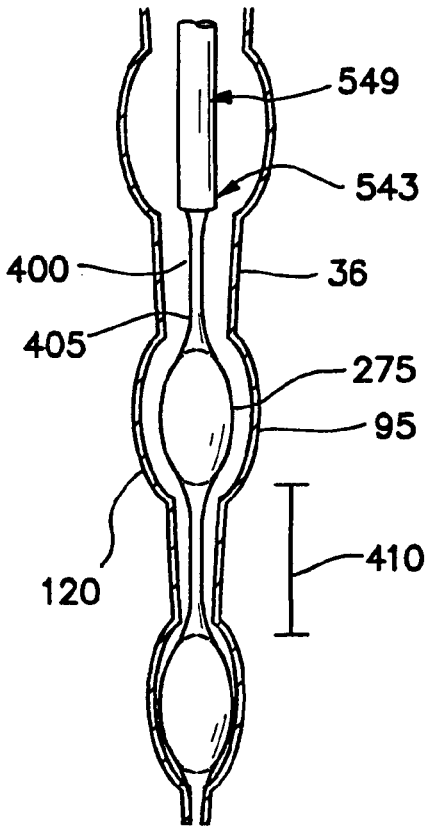
FIG. 46 is a cross-sectional view of an apparatus for inserting cell-shaped sponges into the pressure cells inside of a flexible tube.

(53) In yet a further variant of the apparatus for fabricating an ovoid flexible pressure vessel 10, as shown in FIG. 46, a series of cell-shaped sponges 275 are provided. A tube 400 is provided. The tube 400 is formed of flexible gas and liquid impervious material 405 and is sized and shaped to surround the sponges 275. Means 549 are provided for inserting the sponges 275 in the tube 400 at spaced intervals 410. Means 543 are provided for inserting the encased sponges 275 between the upper cell portions 95 and the lower cell portions 120 prior to joining the upper 95 and lower 120 cell portions. The tube 400 extends through the passageway 36.

Figure 47:
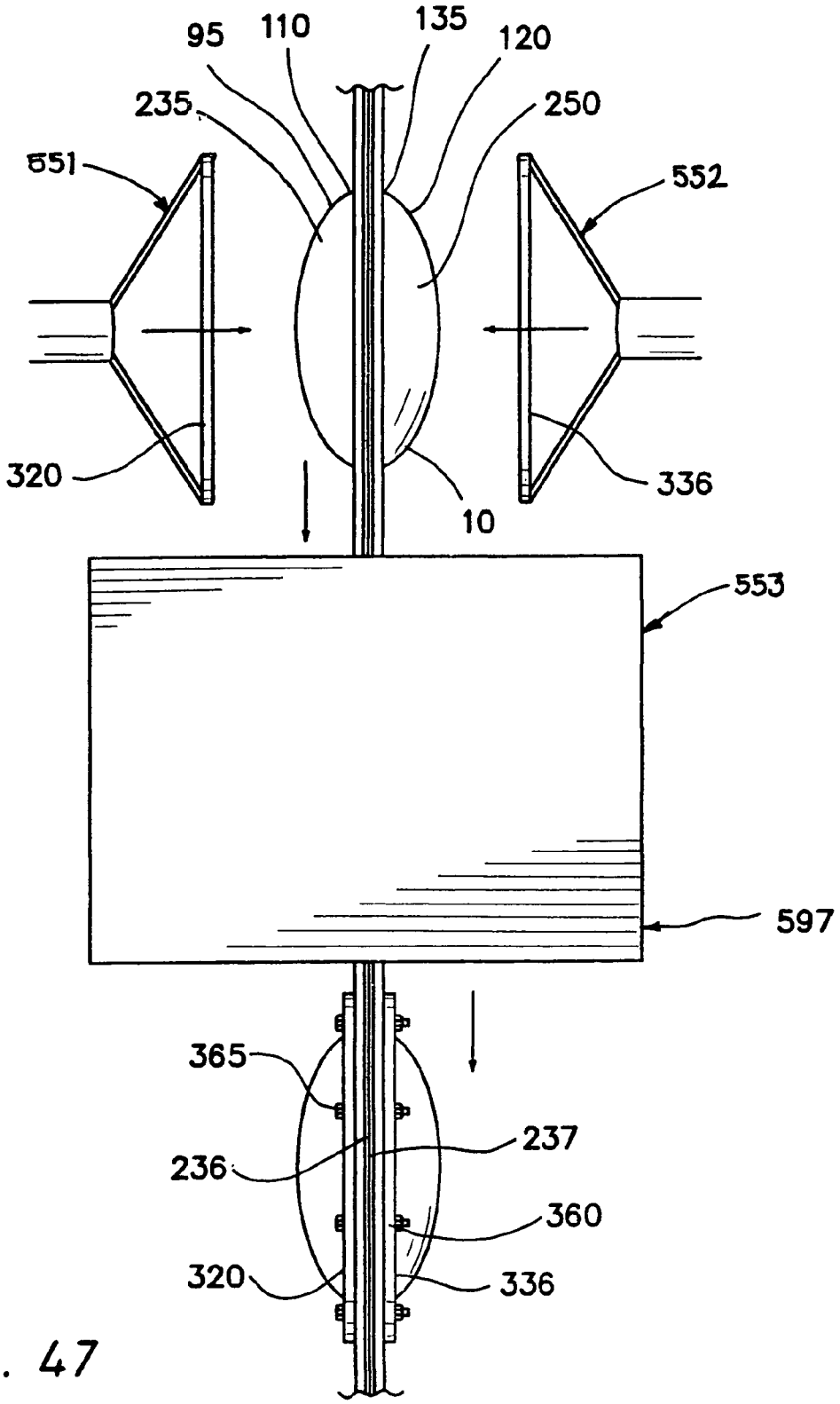
FIG. 47 is a side elevational view of an apparatus for attaching upper and lower retaining plates to the pressure cells.

(54) In still a further variant of the apparatus for fabricating an ovoid flexible pressure vessel 10, as shown in FIG. 47, means 551 are provided for positioning an upper retaining plate 320 to fit over the upper cell portion 95 and surround its outer perimeter 110 when the upper cell portion 95 is covered by the first blanket 235. Means 552 are provided for positioning a lower retaining plate 336 to fit over the lower cell portion 120 and surround its outer perimeter 135 when the lower cell portion 120 is covered by the second blanket 250. Means 553 are provided for producing a series of holes 360. The holes 360 penetrate the upper retaining plate 320 between its outer circumference 330 and the third inner circumference 325, the lower retaining plate 336 between its outer circumference and the fourth inner circumference and the first blanket 235, a border of sheet material 236 surrounding the outer perimeter 110 of the upper cell portion 95, a border of sheet material 237 surrounding the outer perimeter 135 of the lower cell portion 120 and the second blanket 250. The holes 360 are outside of the outer circumference 76 of the reinforcing ring 55. Means 597 are provided for inserting and securing fastening means 365 through the holes 360, thereby securing the upper 320 and lower 336 retaining plates to each other.

Figure 49:
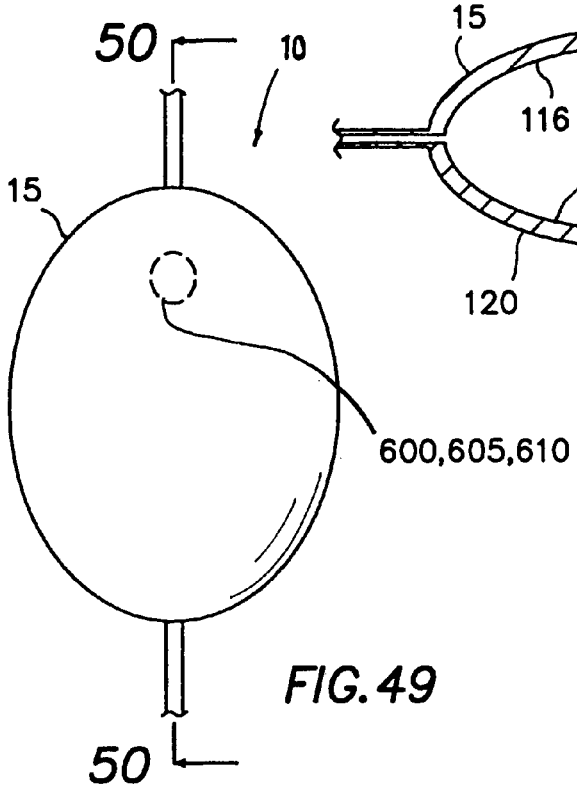
FIG. 49 is a plan view of an embodiment of the invention illustrating a first pressure relief device located on an inner surface of the hollow pressure cell.
Figure 50:
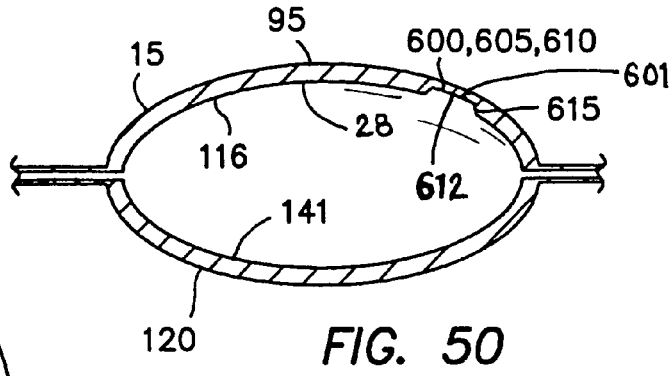
FIG. 50 is a cross-sectional view of the FIG. 49 embodiment taken along the line 50—50, illustrating the first pressure relief device on the inner surface of the hollow pressure cell.

(73) In another variant of the invention, as shown in FIGS. 49 and 50, the flexible pressure vessel 10 has a first pressure relief device 600. The first pressure relief device 600 is located upon the inner surface 28 of the hollow pressure cell 15 and has a reduction in thickness 601 of the hollow pressure cell 15 at a predetermined location 605. When the hollow pressure cell 15 is subjected to an overpressure condition it will fail at the predetermined location 605.

(74) In yet another variant of the invention, as shown in FIG. 50, the first pressure relief device 600 has an indentation 612 in the inner surface 28 of the hollow pressure cell 15. The indentation 612 has side walls 615 angled inwardly from the inner surface 28.

(75) In still another variant of the invention, as shown in FIGS. 49 and 50, the ovoid flexible pressure vessel 10 has a first pressure relief device 610. The first pressure relief device 610 is located on the inner surface 116, 141 of either the upper dome-shaped cell portion 95 or the lower dome-shaped cell portion 120 and has a reduction in thickness 601 of one of the dome-shaped cell portions 95, 120 at a predetermined location 605. When said hollow pressure cell 15 is subjected to an overpressure condition it will fail at said predetermined location 605.

(76) In a further variant, as shown in FIGS. 49 and 50, the first pressure relief device 610 has an indentation 612 in the inner surface 116, 141 of either the upper dome-shaped cell portion 95 or the lower dome-shaped cell portion 120. The indentation 612 has side walls 615 angled inwardly from the inner surface 116, 141.

Figure 52:
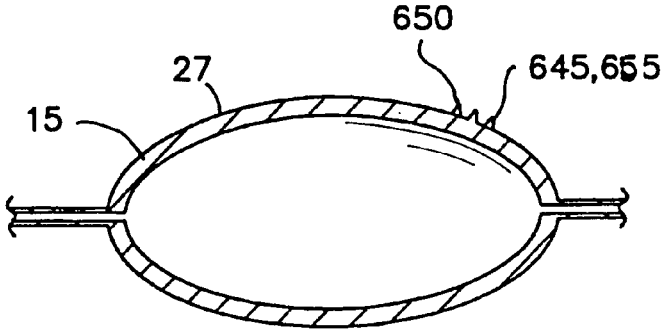
FIG. 52 is a cross sectional view of the FIG. 51 embodiment of the invention taken along the line 52—52 illustrating the second pressure relief device that has at least one projecting member.
Figure 51:
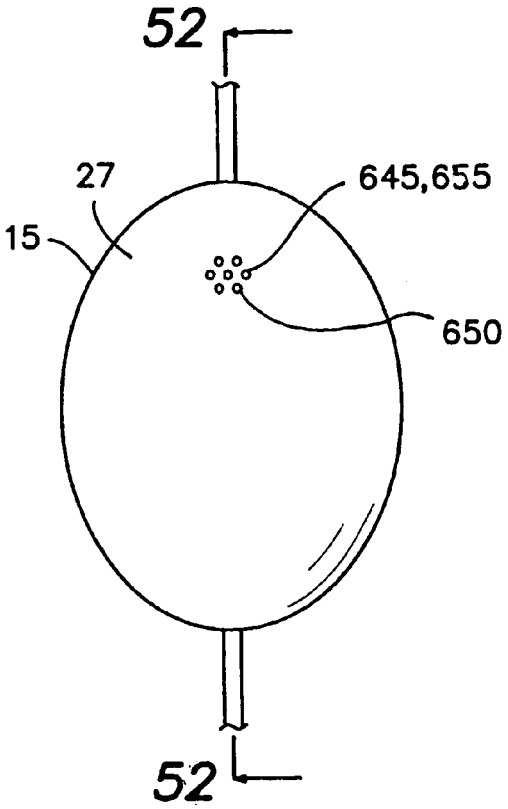
FIG. 51 is a plan view of an embodiment of the invention illustrating a second pressure relief device located on an outer surface of the hollow pressure cell.
Figure 53:
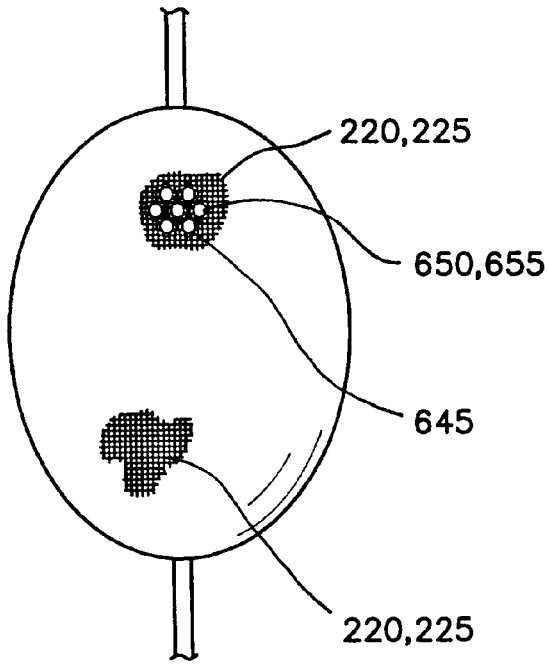
FIG. 53 is a plan view of an embodiment of the invention illustrating penetration of the second pressure relief device through the high strength braiding material at a predetermined location.

(77) In another variant, as shown in FIGS. 51, 52 and 53, the ovoid flexible pressure vessel 10 has a second pressure relief device 645. The second pressure relief device 645 is located on the outer surface 27 of the hollow pressure cell 15 and has at least one projecting member 650. The projecting member 650 is sized and shaped to penetrate the high-strength braiding material 220 at a predetermined location 655. When the high-strength braiding material 220 is penetrated by the projecting member 650 and the hollow pressure cell 15 is subjected to an overpressure condition, the cell 15 will fail at the predetermined location 655.

Figure 55:
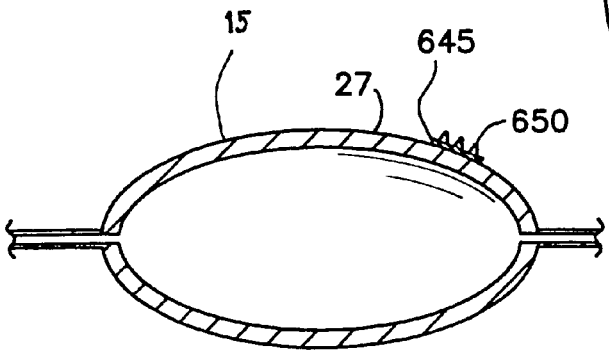
FIG. 55 is a cross-sectional view of the FIG. 54 embodiment taken along the line 55—55.
Figure 54:
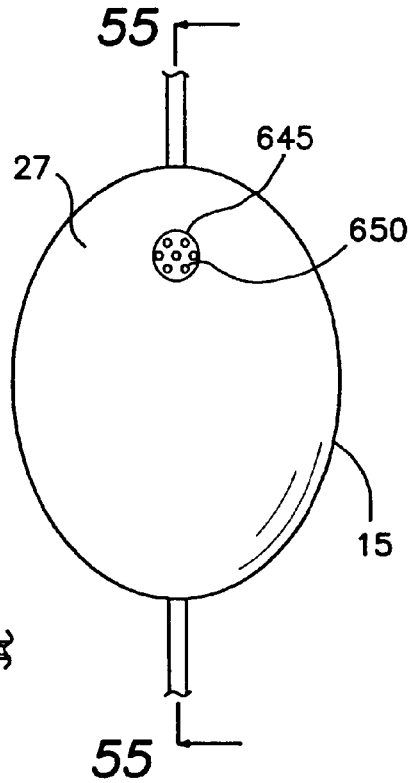
FIG. 54 is a plan view of the FIG. 51 embodiment illustrating a second pressure relief device which is removably attached.

(78) In yet another variant, as shown in FIGS. 54 and 55, the projecting member 650 is removably attached to the outer surface 27 of the hollow pressure cell 15.

(79) In still a further variant, as shown in FIGS. 51, 52 and 53, the ovoid flexible pressure vessel 10 has a second pressure relief device 645. The second pressure relief device 645 is located on the outer surface 27 of the hollow pressure cell 15 and has at least one projecting member 650. The projecting member 650 is sized and shaped to penetrate the hoop winding 225 at a predetermined location 655. When the hoop winding 225 is penetrated by the projecting member 650 and the hollow pressure cell 15 is subjected to an overpressure condition, the cell 15 will fail at the predetermined location 655.

(80) In another variant of the invention, as shown in FIGS. 54 and 55, the at least one projecting member 650 is removably attached to the outer surface 27 of the hollow pressure cell 15.

(81) In yet another variant of the invention, as shown in FIGS. 51 and 52, the ovoid flexible pressure vessel 10 has a second pressure relief device 645. The second pressure relief device 645 is located on the outer surface 27 of the hollow pressure cell 15 and has at least one projecting member 650. The projecting member 650 is sized and shaped to penetrate either the first flexible blanket 235 or the second flexible blanket 250 at a predetermined location 655. When either the first flexible blanket 235 or the second flexible blanket 250 is penetrated by the projecting member 650 and the hollow pressure cell 15 is subjected to an overpressure condition, the cell 15 will fail at the predetermined location 655.

(82) In still a another variant of the invention, as shown in FIGS. 54 and 55, the projecting member 650 is removably attached to the outer surface 27 of the hollow pressure cell 15.

(83) In another embodiment, as shown in FIGS. 51 and 52, the ovoid flexible pressure vessel 10 has a second pressure relief device 645. The second pressure relief device 645 is located upon the outer surface 27 of the hollow pressure cell 15 and has at least one projecting member 650. The projecting member 650 is sized and shaped to penetrate either the upper 411 or lower 415 reinforcing panels at a predetermined location 655. When either the upper 411 or lower 415 reinforcing panels is penetrated by the projecting member 650 and the hollow pressure cell 15 is subjected to an overpressure condition, the cell 15 will fail at the predetermined location 655.

(84) In yet another variant, as shown in FIGS. 54 and 55, the projecting member 650 is removably attached to the outer surface 27 of the hollow pressure cell 15.

Figure 59:
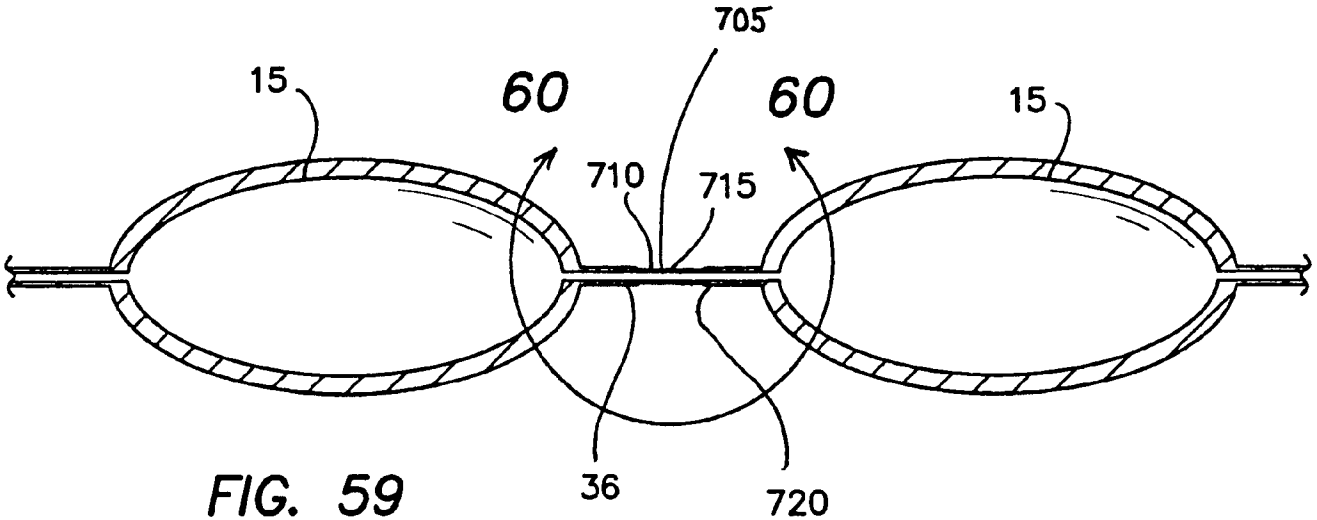
FIG. 59 is a cross-sectional view of an embodiment illustrating a third pressure relief device with a weakened section of the passageway.
Figure 60:
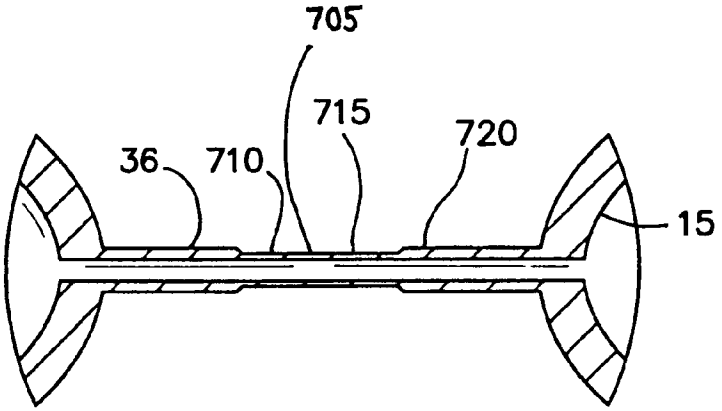
FIG. 60 is a partial detailed view of the FIG. 59 embodiment taken along the line 60—60 illustrating the third pressure relief device.

(85) In still another variant, as shown in FIGS. 59 and 60, the ovoid flexible pressure vessel 10 has a third pressure relief device 705. The third pressure relief device 705 has a weakened section 710 of the passageway 36. When the hollow pressure cell 15 is subjected to an overpressure condition, the cell 15 will fail at the weakened section 710 of the passageway 36.

(86) In a another variant, FIGS. 59 and 60, the weakened section 710 of the passageway 36 has a smaller cross-sectional area 715 than a balance 720 of the passageway 36.

Figure 65:
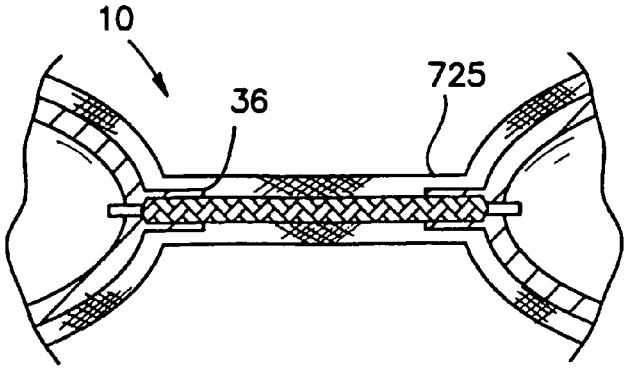
FIG. 65 is a cross-sectional view of an embodiment with high strength braiding material wound about the passageway providing additional resistance to pressure for the pressure vessel.

(87) In a further variant, as shown in FIG. 65, the ovoid flexible pressure 10 has a high-strength braiding material 725 wound about the passageway 36, thereby providing additional resistance to pressure in the flexible pressure vessel 10.

Figure 66:
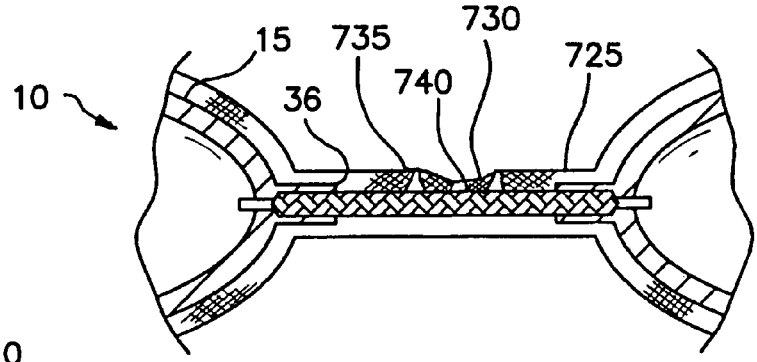
FIG. 66 is a cross-sectional view of the FIG. 65 embodiment illustrating a fourth pressure relief device that has either an absence or a weakening of high strength braiding material at a predetermined location on the passageway.

(88) In yet another variant, as shown in FIG. 66, the ovoid flexible pressure vessel 10 has a fourth pressure relief device 730. The fourth pressure relief device 730 has either a weakening or an absence of high-strength braiding material 735 at a predetermined location 740 along the passageway 36. When the hollow pressure cell 15 is subjected to an overpressure condition, the cell 15 will fail at the predetermined location 740 along the passageway 36.

Figure 67:
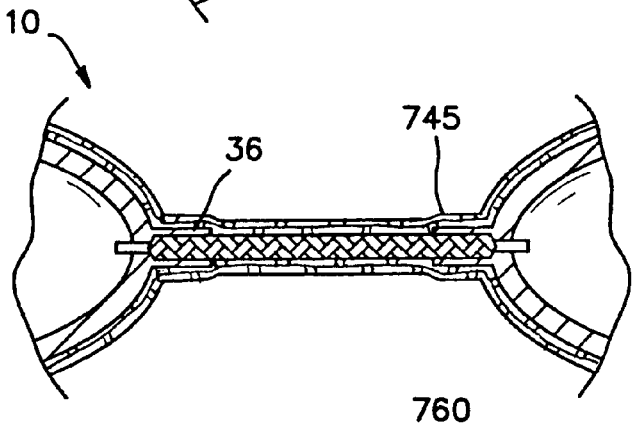
FIG. 67 is a cross-sectional view of an embodiment with hoop winding about the passageway providing additional resistance to pressure for the pressure vessel.

(89) In still another variant, as shown in FIG. 67, the ovoid flexible pressure 10 has hoop winding 745 about the passageway 36, thereby providing additional resistance to pressure in the flexible pressure vessel 10.

Figure 68:
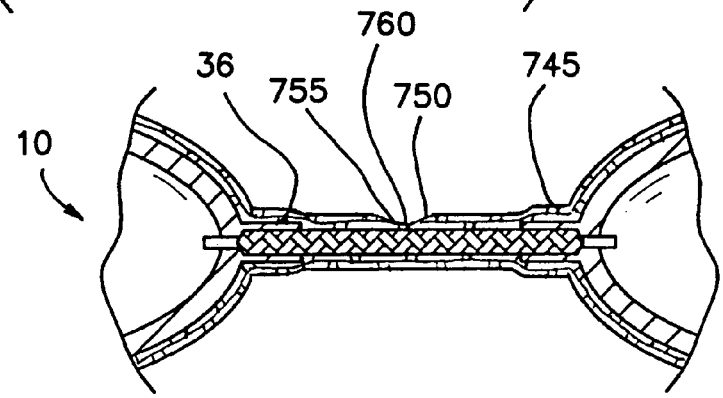
FIG. 68 is a cross-sectional view of the FIG. 67 embodiment illustrating a fourth pressure relief device that has either an absence or a weakening of hoop winding at a predetermined location on the passageway.

(90) In another variant of the invention, as shown in FIG. 68, the ovoid flexible pressure vessel 10 has a fifth pressure relief device 750. The fifth pressure relief device 750 has either a weakening or an absence of hoop winding 755 at a predetermined location 760 along the passageway 36. When the hollow pressure cell 15 is subjected to an overpressure condition, the cell 15 will fail at the predetermined location 760 along the passageway 36.

Figure 63:
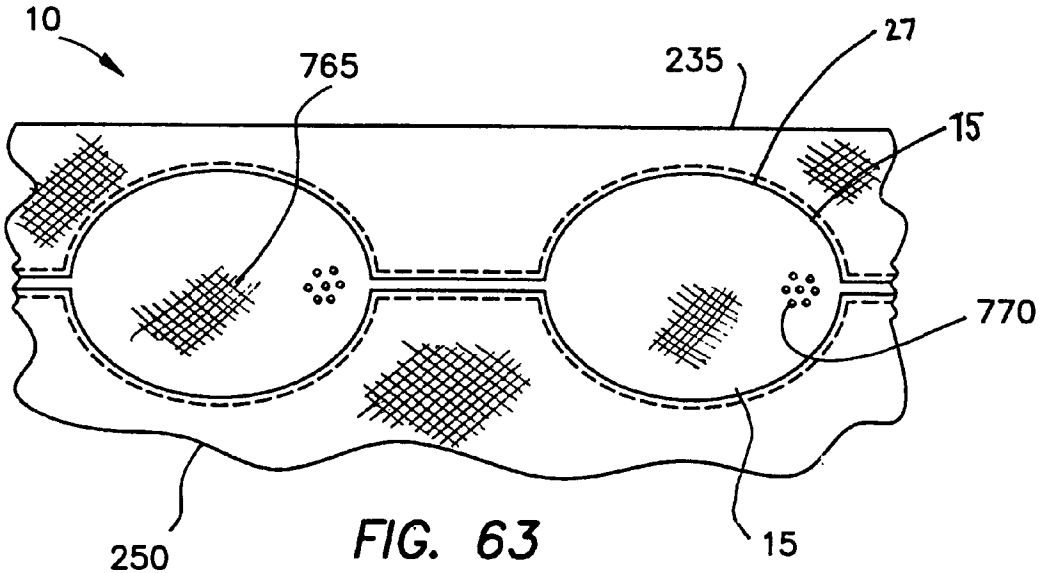
FIG. 63 is a plan view of the FIG. 49 embodiment illustrating the a weakening or spreading of fibers in the flexible blanket at predetermined location.
Figure 64:
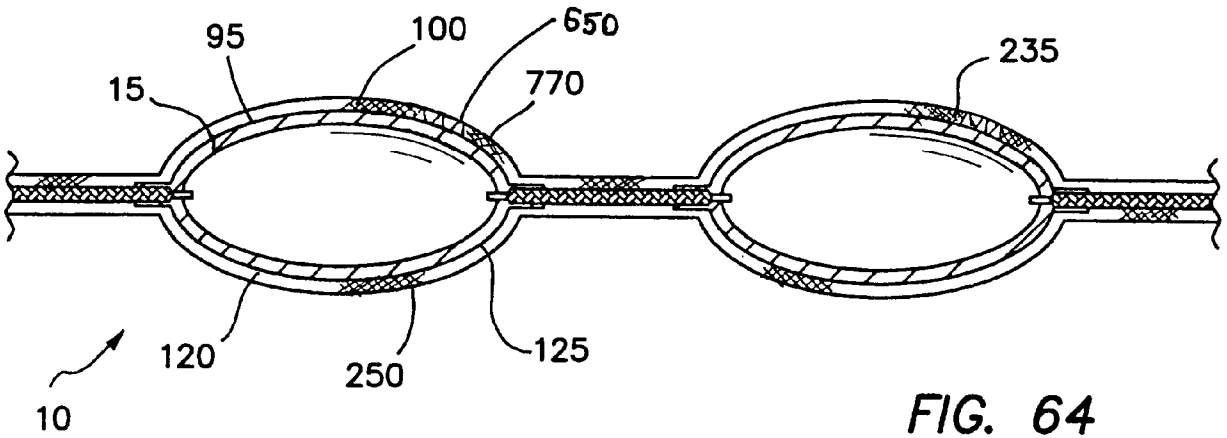
FIG. 64 is a cross-sectional view of the FIG. 63 embodiment illustrating the weakening or spreading of fibers in the flexible blanket at predetermined location.

(91) In a further variant of the invention, as shown in FIGS. 63 and 64, the ovoid flexible pressure vessel 10 has either a weakening or a spreading of fibers 765 in either of the first flexible blanket 235 or the second flexible blanket 250 at a predetermined location 770. The predetermined location 770 is above the outer surface 100, 125 of either the upper cell portion 95 or the lower cell portion 120. When either the first flexible blanket 235 or the second flexible blanket 250 has the fibers weakened or spread 765 in the predetermined location 770 and the hollow pressure cell 15 is subjected to an overpressure condition, the cell 15 will fail at the predetermined location 770.

Figure 57:
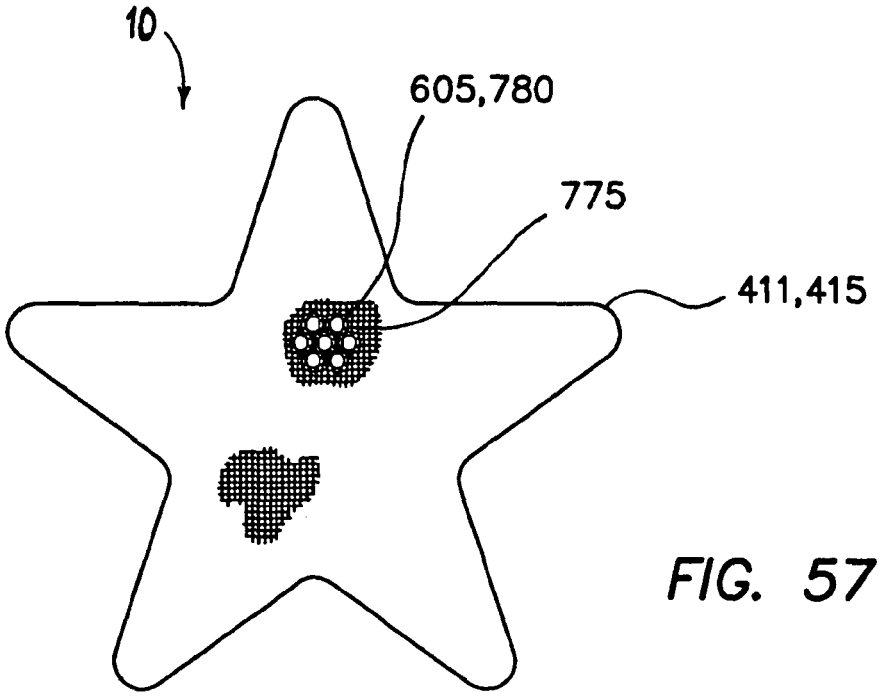
FIG. 57 is a plan view of a reinforcing panel with either a weakening or spreading of fibers at a predetermined location.
Figure 58:
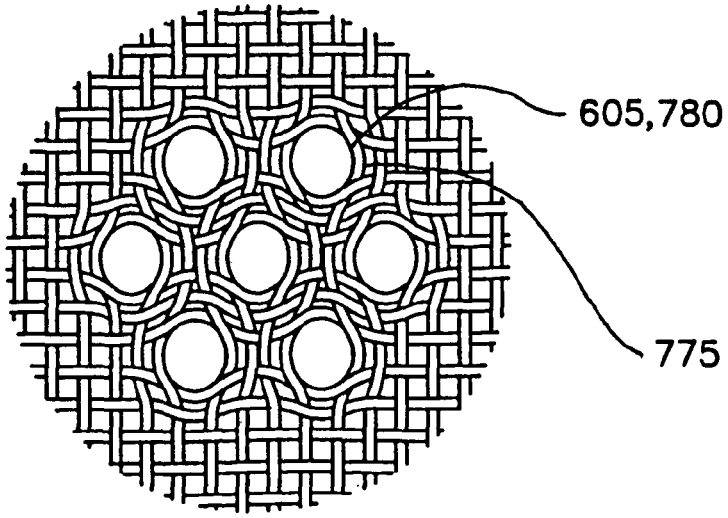
FIG. 58 is a partial detail view of a reinforcing panel or high strength braiding material with either a weakening or spreading of fibers at a predetermined location.

(92) In yet another variant of the invention, as shown in FIGS. 57 and 58, the ovoid flexible pressure vessel 10 has either a weakening or a spreading of fibers 775 in either the upper 411 or lower 415 reinforcing panels at a predetermined location 780. The predetermined location 780 is above the outer surface 100, 125 of either of the upper cell portion 95 or the lower cell portion 120. When either the upper 411 or lower 415 reinforcing panels has the fibers weakened or spread 775 in the predetermined location 780 and the hollow pressure cell 15 is subjected to an overpressure condition, the cell 15 will fail at the predetermined location 780.

Figure 61:
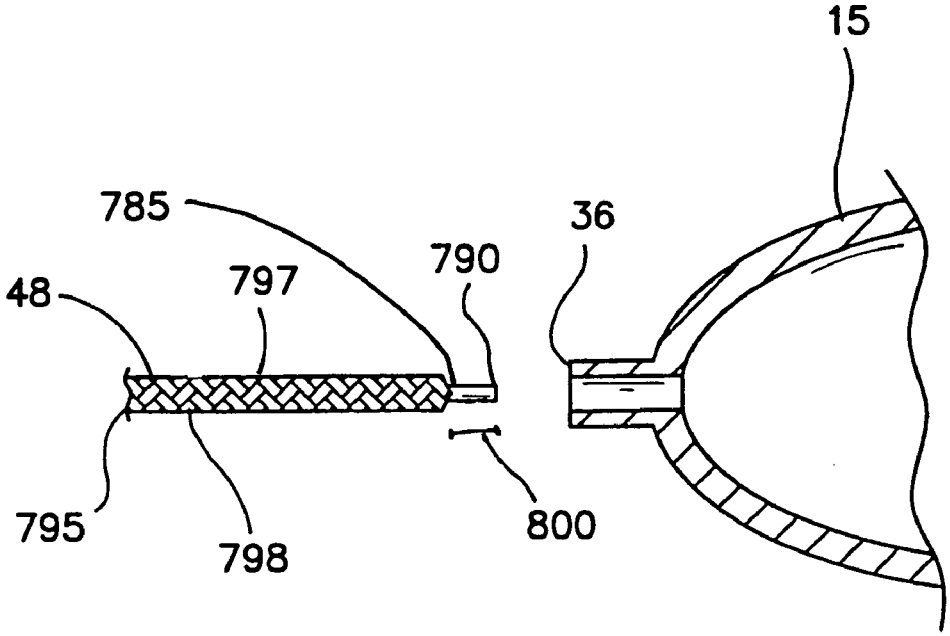
FIG. 61 is a cross-sectional view of an embodiment illustrating the process of connection of a capillary tube to a passageway and hollow pressure cell prior to insertion and welding.
Figure 62:
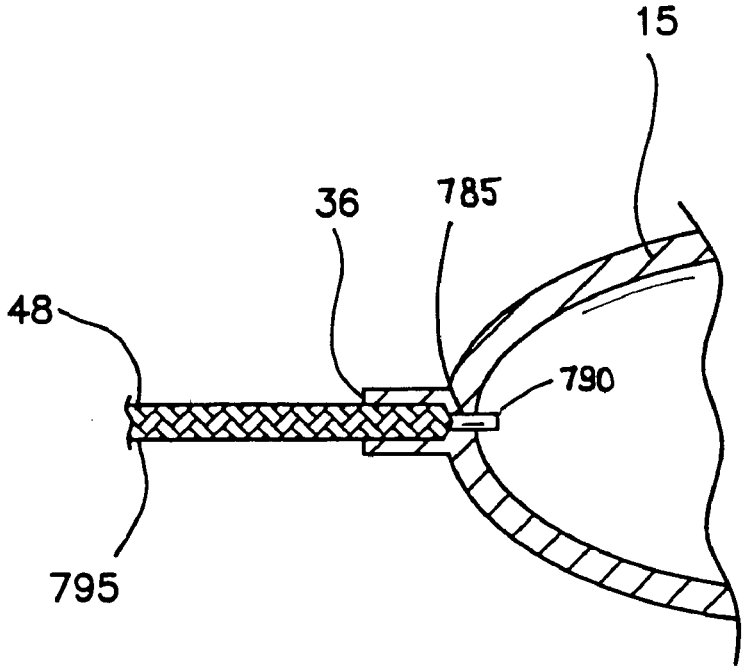
FIG. 62 is a cross-sectional view of the FIG. 61 embodiment illustrating attachment of the capillary tube to the passageway and hollow pressure cell.

(93) In still a further variant of the invention, as shown in FIGS. 61 and 62, the connection 48 to either a passageway 36 of another cell 15 or a valve 50 has a capillary tube 785. The capillary tube 785 has a proximate 790 end and a distal 795 end and is formed of resilient material 798. The tube 785 is sized and shaped to fit slidably within the passageway 36.

The connection 48 to either a passageway 36 of another cell 15 or a valve 50 also has a high-strength braiding material 797. The braiding material 797 is located about the capillary tube 785 and extends along the tube 785 to within a first predetermined distance 800 from the proximate end 790.

The proximate end 790 of the braiding 797 covered capillary tube 785 is inserted into the passageway 36 and either radio frequency welded or secured with adhesive. When the proximate end 790 of the capillary tube 785 is either welded or secured with adhesive within the passageway 36, it will be permanently attached to it.

Figure 56:
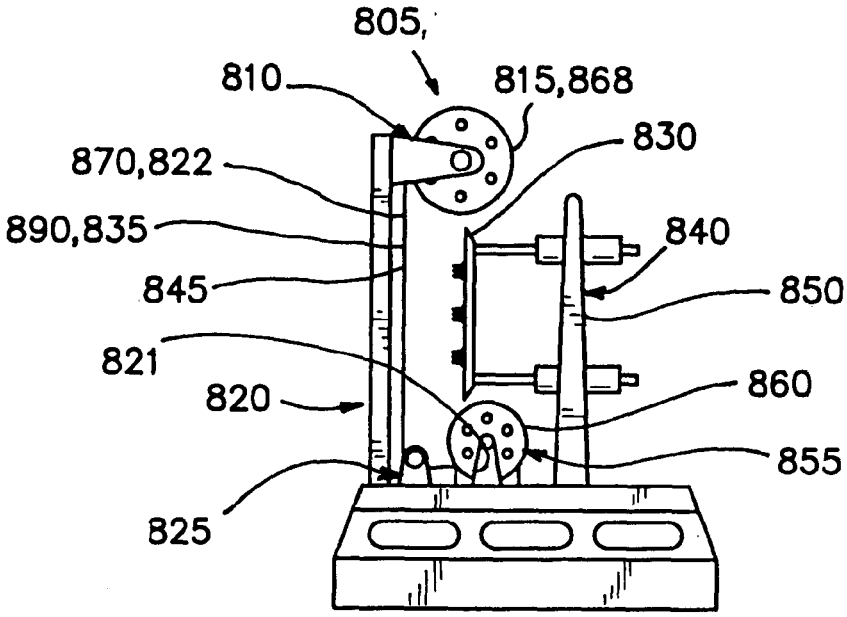
FIG. 56 is a side elevational view of an apparatus for modifying flexible blanket material and for modifying reinforcing panel material.
Figure 56A:
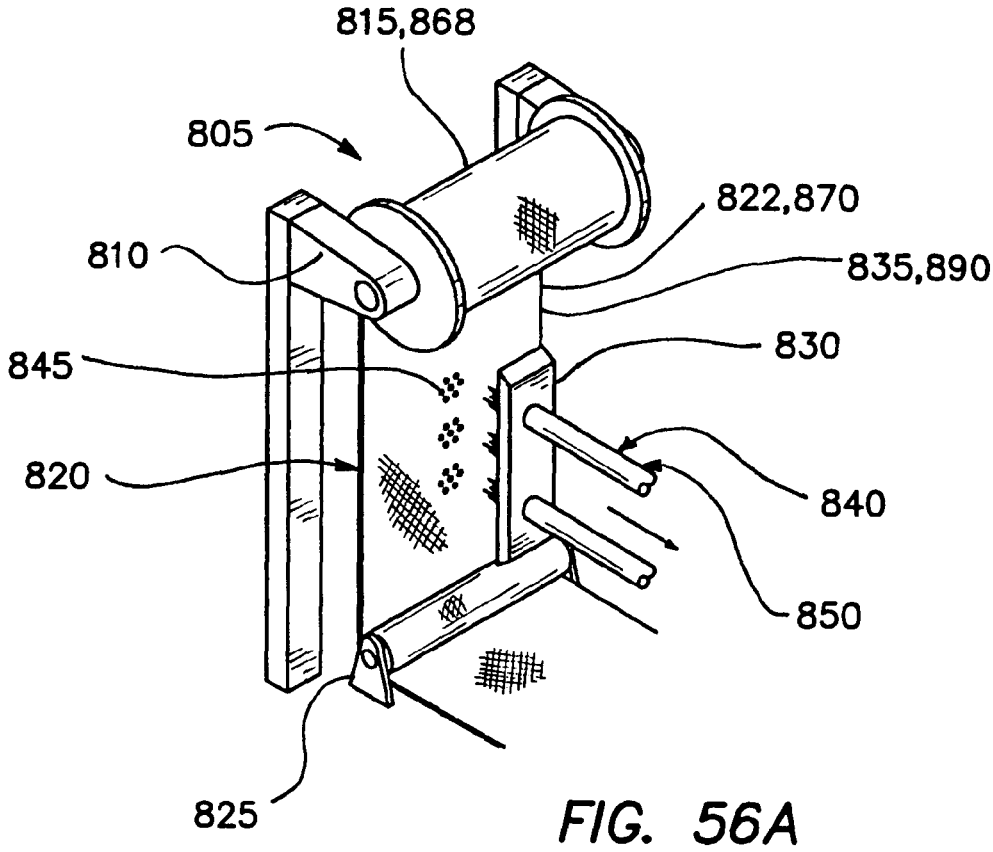
FIG. 56A is perspective view of the FIG. 56 apparatus illustrating the modified fabric or blanket material.

(94) In another variant, as shown in FIGS. 56 and 56A, an apparatus 805 for modifying flexible blanket material 822 is provided. The apparatus 805 has a means 810 for supporting a supply roll 815 of flexible blanket material 822. A means 821 for moving the flexible blanket material 822 from the supply roll 815 to a work area 820 is provided. Means 825 for tensioning the flexible blanket material 822 in the work area 820 are also provided. At least one separating member 830 is provided. The separating member 830 is sized and shaped to penetrate and separate fibers 835 of the flexible blanket material 822.

Means 840 for moving the separating member 830 into the tensioned flexible blanket material 822 at a predetermined location 845 in the material 822, thereby either weakening or separating the fibers 835, is provided. Means 850 for retracting the separating member 830 from the tensioned flexible blanket material 822 is provided. Means 855 for moving the flexible blanket material 822 from the work area 820 to a storage area 860 is provided. The flexible blanket material 822 will have either weakened or separated fibers 835 in the predetermined location 845 prior to application to the hollow pressure cell 15.

(95) In a further variant, as shown in FIGS. 56 and 56A, an apparatus 805 for modifying reinforcing panel material 870 is provided. The apparatus 805 has means 810 for supporting a supply roll 868 of reinforcing panel material 870. Means 821 for moving the reinforcing panel material 870 from the supply roll 868 to a work area 820 is provided. Means 825 for tensioning the reinforcing panel material 870 in the work area 820 is provided. At least one separating member 830 is provided. The separating member 830 is sized and shaped to penetrate and separate fibers 890 of the reinforcing panel material 870. Means 840 for moving the separating member 830 into the tensioned reinforcing panel material 870 at a predetermined location 845 in the material 870, thereby either weakening or separating the fibers 890, is provided. Means 850 for retracting the separating member 830 from the tensioned reinforcing panel material 870 is provided. Means 855 for moving the reinforcing panel material 870 from the work area 820 to a storage area 860 is provided. The reinforcing panel material 870 will have either weakened or separated fibers 890 in the predetermined location 845 prior to application to the hollow pressure cell 15.

The invention claimed is:

1. An ovoid flexible pressure vessel, comprising:

at least one hollow pressure cell, said pressure cell having symmetrical upper and lower cell portions, being formed of resilient material and having an outer surface, an inner surface, an outer perimeter, and at least one opening disposed at said outer perimeter;

a passageway, said passageway having a first end and a second end and being attached to said at least one opening at said first end and extending outwardly beyond said hollow pressure cell as a connection to either of a passageway of another cell and a valve;

at least one reinforcing ring, said reinforcing ring having an inner surface, an outer surface, an outer circumference, and being sized and shaped to fit tightly about the outer perimeter of said pressure cell;

said reinforcing ring having an aperture, said aperture extending from said inner surface to said outer surface and being sized, shaped and disposed to accommodate connection of said passageway to said pressure cell;

a valving means, said valving means being capable of controlling a flow of either of a liquid and a gas through said passageway and being attached to said second end of said passageway; and whereby, when said reinforcing ring is disposed about the outer perimeter of said pressure cell, the pressure handling capacity of said cell is increased.

2. An ovoid flexible pressure vessel comprising:

at least one upper dome-shaped cell portion, said upper cell portion being formed from resilient material and having an outer surface, an inner perimeter, an outer perimeter, an inner surface and at least one upper opening portion, said upper opening portion extending outwardly from said inner perimeter;

at least one mating lower dome-shaped cell portion, said lower cell portion being formed from resilient material and having an outer surface, an inner perimeter, an outer perimeter, an inner surface and at least one lower opening portion, said lower opening portion extending outwardly from said inner perimeter;

said upper cell portion being joined to said mating lower cell portion such that a hollow pressure cell is formed, said cell having at least one opening;

a passageway, said passageway having a first end and a second end and being attached to said at least one opening at said first end and extending outwardly beyond said hollow pressure cell as a connection to either of a passageway of another cell and a valve;

at least one reinforcing ring, said reinforcing ring having an inner surface, an outer surface, an outer circumference, and being sized and shaped to fit tightly about the outer perimeter of said pressure cell;

said reinforcing ring having an aperture, said aperture extending from said inner surface to said outer surface and being sized, shaped and disposed to accommodate connection of said passageway to said pressure cell; and a valving means, said valving means being capable of controlling a flow of either of a liquid and a gas through said passageway and being attached to said second end of said passageway.

3. An ovoid flexible pressure vessel as described in claim 1 or claim 2, further comprising:

a protruding rim, said protruding rim being disposed at said outer perimeter of said pressure cell upper and lower receiving notches, said upper and lower receiving notches being disposed above and below said protruding rim;

upper and lower projecting ribs, said upper and lower projecting ribs being disposed upon said inner surface of said reinforcing ring;

a central receiving notch, said central receiving notch being disposed between said upper and lower projecting ribs;

said projecting ribs being sized, shaped and disposed to fit said upper and lower receiving notches of said pressure cell;

said central receiving notch being sized, shaped and disposed to fit said protruding rim of said pressure cell; and whereby, when said reinforcing ring is disposed about the outer perimeter of said pressure cell, the pressure handling capacity of said cell is increased.

4. An ovoid flexible pressure vessel comprising:

at least one upper dome-shaped cell portion, said upper cell portion being formed from resilient material and having an outer surface, an inner perimeter, an outer perimeter, an inner surface and at least one upper passageway portion, said upper passageway portion extending outwardly from said inner perimeter;

at least one mating lower dome-shaped cell portion, said lower cell portion being formed from resilient material and having an outer surface, an inner perimeter, an outer perimeter, an inner surface and at least one lower passageway portion, said lower passageway portion extending outwardly from said inner perimeter;

said upper cell portion being joined to said mating lower cell portion such that a hollow pressure cell is formed, said cell having at least one passageway extending outwardly from said cell as a connection to either of a passageway of another cell and a valve;

a protruding rim, said protruding rim being disposed at said outer perimeter of said pressure cell upper and lower receiving notches, said upper, and lower receiving notches being disposed above and below said protruding rim; and upper and lower a reinforcing rings, each of said reinforcing rings having an inner surface, an outer surface, and being sized and shaped to fit tightly in either of said upper and lower receiving notches;

at least one of said reinforcing rings having an aperture, said aperture extending from said inner surface to said outer surface and being sized shaped and disposed to accommodate connection of said passageway to said pressure cell; and whereby, when said reinforcing rings are disposed about said outer perimeter of said pressure cell, the pressure handling capacity of said cell is increased.

5. An ovoid flexible pressure vessel as described in claim 4, further comprising means for fastening said upper reinforcing ring to said lower reinforcing ring.

6. An ovoid flexible pressure vessel comprising:

at least one upper dome-shaped cell portion, said upper cell portion being formed from resilient material and having an outer surface, an inner perimeter, an outer perimeter, an inner surface and at least one upper passageway portion, said upper passageway portion extending outwardly from said inner perimeter;

at least one mating lower dome-shaped cell portion, said lower cell portion being formed from resilient material and having an outer surface, an inner perimeter, an outer perimeter, an inner surface and at least one lower passageway portion, said lower passageway portion extending outwardly from said inner perimeter;

said upper cell portion being joined to said mating lower cell portion such that a hollow pressure cell is formed, said cell having at least one passageway extending outwardly from said pressure cell as a connection to either of a passageway of another cell and a valve;

a protruding rim, said protruding rim being disposed at said outer perimeter of said pressure cell;

at least one groove disposed about said outer perimeter above said protruding rim;

at least one groove disposed about said outer perimeter below said protruding rim;

upper and lower reinforcing rings, each of said reinforcing rings having an inner surface, an outer surface, and being sized and shaped to fit tightly about said outer perimeter on either side of said protruding rim;

said reinforcing rings having at least one rib disposed upon said inner surface thereof, said rib being sized, shaped and disposed to engage said groove; and whereby, when said reinforcing rings are disposed about said outer perimeter of said pressure cell, the pressure handling capacity of said cell is increased.

7. An ovoid flexible pressure vessel as described in claim 6, further comprising means for fastening said upper reinforcing ring to said lower reinforcing ring.

8. An oyoid flexible pressure vessel as described in claims 1, 2, 4 or 6, further comprising:

an overwrapping layer, said overwrapping layer being formed of high-strength braiding material wound around said hollow pressure cell; and whereby, when the hollow pressure cell is overwrapped with high-strength braiding material, the pressure handling capacity of said pressure cell is increased.

9. An ovoid flexible pressure vessel as described in claims 1, 2, 4 or 6, further comprising hoop winding, said hoop winding being around said hollow pressure cell to increase the pressure handling capacity of said pressure cell.

10. An ovoid flexible pressure vessel as described in claim 8, further comprising a plastic overcoating.

11. An ovoid flexible pressure vessel as described in claims 1, 2, 4 or 6, further comprising:

a first flexible blanket, said first blanket having an upper surface, a lower surface and being sized and shaped to cover said upper cell portion and extending outwardly beyond said outer perimeter;

said first blanket being fixedly attached at its lower surface to said outer surface of said upper cell portion;

a second flexible blanket, said second blanket having an upper surface, a lower surface and being sized and shaped to cover said lower cell portion and extending outwardly beyond said outer perimeter; and said second blanket being fixedly attached at its upper surface to said outer surface of said lower cell portion.

12. An ovoid flexible pressure vessel as described in claim 11, wherein heavy duty stitching is used to attach said first blanket to said second blanket, said stitching penetrating said first and second blankets between said upper and lower cell portions and serving to further reinforce and increasing the pressure handling capability of said pressure cell.

13. An ovoid flexible pressure vessel as described in claim 12, wherein said heavy duty stitching is high pressure hoop and lock braiding.

14. An ovoid flexible pressure vessel as described in claims 2, 4 or 6, wherein a cell-shaped sponge is inserted between said upper cell portion and said lower cell portion prior to joining said upper and lower cell portions, said sponge serving to prevent said cell from collapsing after either of gas and liquid is removed from said cell.

15. An ovoid flexible pressure vessel as described in claim 14, wherein said sponge is impregnated with a zeolite compound, a gas or liquid absorbing compound or a reactive fuel cell compound.

16. An ovoid flexible pressure vessel as described in claim 11, wherein either of a heat-reflecting plastic film and a metal foil is inserted between at least one of said first blanket and said upper cell portion and said second blanket and said lower cell portion.

17. An ovoid flexible pressure vessel as described in claims 2, 4 or 6, wherein said upper cell portion is joined to said lower cell portion by either of radio frequency welding and high strength adhesive.

18. An ovoid flexible pressure vessel as described in claim 11, wherein either of said first and second blankets is formed of high-strength fiber impregnated material.

19. An ovoid flexible pressure vessel as described in claims 1, 2, 4 or 6, wherein said passageway has a cross-section of between 0.025 and 0.250 inches.

20. An ovoid flexible pressure vessel as described in claim 11, further comprising:

an upper retaining plate, said upper retaining plate having a third inner circumference, an outer circumference and a third pre-determined thickness;

said upper retaining plate being sized and shaped to fit over said upper cell portion and surround its outer perimeter when said upper cell portion is covered by said first blanket;

said third inner circumference being larger than said outer circumference of said reinforcing ring;

a lower retaining plate, said lower retaining plate having a fourth inner circumference, an outer circumference and a fourth pre-determined thickness;

said lower retaining plate being sized and shaped to fit over said lower cell portion and surround its outer perimeter when said lower cell portion is covered by said second blanket;

said fourth inner circumference being larger than said outer circumference of said reinforcing ring;

means for attaching said upper retaining plate to said lower retaining plate; and whereby, when said upper retaining plate is attached to said lower retaining plate, surrounding said upper and lower cell portions and said first and second blankets covering said reinforcing rings, the pressure capacity of said pressure cell will be increased.

21. An ovoid flexible pressure vessel as described in claim 20, wherein the means for attaching said upper retaining plate to said lower retaining plate further comprises:

a series of holes, said holes penetrating said upper retaining plate between its outer circumference and said third inner circumference, said lower retaining plate between its outer circumference and said fourth inner circumference and said first blanket, a border of sheet material surrounding said outer perimeter of the upper cell portion, a border of sheet material surrounding said outer perimeter of said lower cell portion and said second blanket;

said holes being outside of said outer circumference of said first and second rings;

a series of fastening means, said fastening means being sized and shaped to pass through said series of holes and being capable of securing said upper retaining plate to said lower retaining plate.

22. An ovoid flexible pressure vessel as described in claim 20, wherein said fastening means is a series of bolt and locking nuts.

23. An ovoid flexible pressure vessel as described in claim 20, wherein said fastening means is a series of rivets.

24. An ovoid flexible pressure vessel as described in claim 20, wherein said means for attaching said upper retaining plate to said lower retaining plate further comprises:

a series of holes, said holes penetrating said upper retaining plate between its outer circumference and said third inner circumference, said first blanket, a border of sheet material surrounding said outer perimeter of said upper cell portion, a border of sheet material surrounding said outer perimeter of said lower cell portion and said second blanket;

said holes being outside of said outer circumference of said first and second rings;

a series of pins, said pins being affixed orthogonally along an upper surface of said lower retaining plate and being sized, shaped and disposed to fit slidably through said series of holes and extending slightly above an upper surface of said upper retaining plate; and a series of welds, said welds fixedly attaching said pins to said upper retaining plate, thereby securing said upper and lower retaining plates to each other.

25. An ovoid flexible pressure vessel as described in claims 2, 4 or 6, further comprising:

a series of cell shaped sponges;

a tube, said tube being formed of flexible gas and liquid impervious material and being sized and shaped to surround said sponges;

said sponges being inserted in said tube at spaced intervals, said encased sponges being inserted between said upper cell portions and the lower cell portions prior to joining said upper and lower cell portions, said tube extending through said passageways;

said sponges serving to prevent said cells from collapsing after either of gas and liquid is removed from said cells; and said tube serving to prevent contamination of either of gas and liquid by said inner surfaces of said upper and lower cell portions.

26. An ovoid flexible pressure vessel as described in claim 25, wherein said sponges are impregnated with a zeolite compound, a gas or liquid absorbing compound or a reactive fuel cell compound.

27. An ovoid flexible pressure vessel as described in claim 25, wherein the tube is formed from material selected from the group comprising:

thermoplastic polyurethane elastomer, polyurethane polyvinyl chloride, polyvinyl chloride, thermoplastic elastomer, Teflon® and polyethylene.

28. An ovoid flexible pressure vessel as described in claims 1, 2, 4 or 6, further comprising:

upper and lower reinforcing panels, said reinforcing panels being formed of high-strength woven material and being substantially ovoid in shape with extensions projecting from a perimeter of said ovoid shape; and said reinforcing panels being adhered to said outer surface of said upper and lower cell portions of said hollow pressure cell, thereby increasing the pressure handling capabilities of said pressure cell.

29. An ovoid flexible pressure vessel as described in claim 28, wherein the method of adhesion is selected from the group comprising:

high-strength adhesive, sonic welding and RF welding.

30. An ovoid flexible pressure vessel as described in claim 28, wherein the woven material is prepregnated with either of adhesive and laminating material and subjected to heat and pressure.

31. An ovoid flexible pressure vessel as described in claims 1, 2, 4 or 6, wherein said passageway is removably attached to said hollow pressure cell.

32. An ovoid flexible pressure vessel as described in claim 29, wherein said passageway is removably attached to said hollow pressure cell by a threaded fitting, said threaded fitting being sized and shaped to fit a threaded opening at said outer perimeter of said hollow pressure cell.

33. An ovoid flexible pressure vessel as described in claims 1, 2, 4 or 6 further comprising:

an orifice, said orifice penetrating either of said upper and lower, cell portions;

a removable plug, said plug being sized and shaped to fit sealably into said orifice, thereby permitting introduction of material into said pressure cell.

34. The ovoid flexible pressure vessel, as described in claim 1, further comprising:

a first pressure relief device, said first pressure relief device disposed upon said inner surface of said hollow pressure cell and comprising a reduction in thickness of said hollow pressure cell at a predetermined location;

whereby, when said hollow pressure cell is subjected to an overpressure condition it will fail at said predetermined location.

35. The ovoid flexible pressure vessel, as described in claim 34, wherein said first pressure relief device comprises an indentation in said inner surface of said hollow pressure cell, said indentation having side walls angled inwardly from said inner surface.

36. The ovoid flexible pressure vessel, as described in claims 2, 4 or 6, further comprising:

a first pressure relief device, said first pressure relief device disposed upon said inner surface of either of said upper dome-shaped cell portion and said mating lower dome-shaped cell portion and comprising a reduction in thickness of one of said dome-shaped cell portion at a predetermined location; and whereby, when said hollow pressure cell is subjected to an overpressure condition it will fail at said predetermined location.

37. The ovoid flexible pressure vessel, as described in claim 36, wherein said first pressure relief device comprises an indentation in said inner surface of either of said upper dome-shaped cell portion and said lower dome-shaped cell portion, said indentation having side walls angled inwardly from said inner surface.

38. The ovoid flexible pressure vessel, as described in claim 8, further comprising:

a second pressure relief device, said second pressure relief device disposed upon said outer surface of said hollow pressure cell and comprising at least one projecting member, said at least one projecting member being sized and shaped to penetrate said high-strength braiding material at a predetermined location; and whereby, when said high-strength braiding material is penetrated by said projecting member and said hollow pressure cell is subjected to an overpressure condition, said cell will fail at said predetermined location.

39. The ovoid flexible pressure vessel, as described in claim 38, wherein said at least one projecting member is removably attached to said outer surface of said hollow pressure cell.

40. The ovoid flexible pressure vessel, as described in claim 9, further comprising:

a second pressure relief device, said second pressure relief device disposed upon said outer surface of said hollow pressure cell and comprising at least one projecting member, said at least one projecting member being sized and shaped to penetrate said hoop winding at a predetermined location; and whereby, when said hoop winding is penetrated by said projecting member and said hollow pressure cell is subjected to an overpressure condition, said cell will fail at said predetermined location.

41. The ovoid flexible pressure vessel, as described in claim 40, wherein said at least one projecting member is removably attached to said outer surface of said hollow pressure cell.

42. The ovoid flexible pressure vessel, as described in claim 11, further comprising:

a second pressure relief device, said second pressure relief device disposed upon said outer surface of said hollow pressure cell and comprising at least one projecting member, said at least one projecting member being sized and shaped to penetrate either of said first flexible blanket and said second flexible blanket at a predetermined location; and whereby, when said either of said first flexible blanket and said second flexible blanket is penetrated by said projecting member and said hollow pressure cell is subjected to an overpressure condition, said cell will fail at said predetermined location.

43. The ovoid flexible pressure vessel, as described in claim 42, wherein said at least one projecting member is removably attached to said outer surface of said hollow pressure cell.

44. The ovoid flexible pressure vessel, as described in claim 28, further comprising:

a second pressure relief device, said second pressure relief device disposed upon said outer surface of said hollow pressure cell and comprising at least one projecting member, said at least one projecting member being sized and shaped to penetrate either of said upper and lower reinforcing panels at a predetermined location; and whereby, when said either of said upper and lower reinforcing panels is penetrated by said projecting member and said hollow pressure cell is subjected to an overpressure condition, said cell will fail at said predetermined location.

45. The ovoid flexible pressure vessel, as described in claim 44, wherein said at least one projecting member is removably attached to said outer surface of said hollow pressure cell.

46. The ovoid flexible pressure vessel, as described in claims 1, 2, 4 or 6, further comprising:

a third pressure relief device, said third pressure relief device comprising a weakened section of said passageway; and whereby, when said hollow pressure cell is subjected to an overpressure condition, said cell will fail at said weakened section of said passageway.

47. The ovoid flexible pressure vessel, as described in claim 46, wherein said weakened section of said passageway has a smaller cross-sectional area than a balance of said passageway.

48. The ovoid flexible pressure vessel, as described in claims 1, 2, 4 or 6, further comprising high-strength braiding material wound about said passageway, thereby providing additional resistance to pressure in said flexible pressure vessel.

49. The ovoid flexible pressure vessel, as described in claim 47, further comprising:

a fourth pressure relief device, said fourth pressure relief device comprising either of a weakening and an absence of high-strength braiding material at a predetermined location along said passageway; and whereby, when said hollow pressure cell is subjected to an overpressure condition, said cell will fail at said predetermined location along said passageway.

50. The ovoid flexible pressure vessel, as described in claims 1, 2, 4 or 6, further comprising hoop winding about said passageway, thereby providing additional resistance to pressure in said flexible pressure vessel.

51. The ovoid flexible pressure vessel, as described in claim 49, further comprising:

a fifth pressure relief device, said fifth pressure relief device comprising either of a weakening and an absence of hoop winding at a predetermined location. along said passageway; and whereby, when said hollow pressure cell is subjected to an overpressure condition, said cell will fail at said predetermined location along said passageway.

52. The ovoid flexible pressure vessel, as described in claim 11, further comprising:

either of a weakening and a spreading of fibers in either of said first flexible blanket and said second flexible blanket at a predetermined location;

said predetermined location being above said outer surface of either of said upper cell portion and said lower cell portion; and whereby, when either of said first flexible blanket and said second flexible blanket has said fibers weakened or spread in said predetermined location and said hollow pressure cell is subjected to an overpressure condition, said cell will fail at said predetermined location.

53. The ovoid flexible pressure vessel, as described in claim 28, further comprising:

either of a weakening and a spreading of fibers in either of said upper and lower reinforcing panels at a predetermined location;

said predetermined location being above said outer surface of either of said upper cell portion and said lower cell portion; and whereby, when either of said upper and lower reinforcing panels has said fibers weakened or spread in said predetermined location and said hollow pressure cell is subjected to an overpressure condition, said cell will fail at said predetermined location.

54. The ovoid flexible pressure vessel, as described in claims 1, 2, 4 or 6, wherein said connection to either of a passageway of another cell and a valve further comprises:

a capillary tube, said capillary tube having a proximate end and a distal end, being formed of resilient material and being sized and shaped to fit slidably within said passageway;

high-strength braiding material, said braiding material disposed about said capillary tube and extending along said capillary tube to within a first predetermined distance from said proximate end;

said proximate end of said braiding covered capillary tube being inserted into said passageway and either of radio frequency welded and secured with adhesive therein;

whereby, when said proximate end of said capillary tube is either of welded and secured with adhesive within said passageway, it will be permanently attached thereto.

55. A method for making the ovoid flexible pressure vessel as described in claim 51, comprising the steps of:

providing a supply roll of flexible blanket material;

supporting said supply roll;

moving said flexible blanket material from said supply roll to a work area;

tensioning said flexible blanket material in said work area;

providing at least one separating member, said separating member being sized and shaped to penetrate and separate fibers of said flexible blanket material;

moving said separating member into said tensioned flexible blanket material at a predetermined location in said material, thereby either of weakening and separating said fibers;

retracting said separating member from said tensioned flexible blanket material;

moving said flexible blanket material from said work area to a storage area; and whereby, said flexible blanket material will have either of weakened and separated fibers in said predetermined location prior to application to said hollow pressure cell.

56. A method for making the ovoid flexible pressure vessel as described in claim 52, comprising:

providing a supply roll of reinforcing panel material;

means for supporting said supply roll;

moving said reinforcing panel material from said supply roll to a work area;

tensioning said reinforcing panel material in said work area;

providing at least one separating member, said separating member being sized and shaped to penetrate and separate fibers of said reinforcing panel material;

moving said separating member into said tensioned reinforcing panel material at a predetermined location in said material, thereby either of weakening and separating said fibers;

retracting said separating member from said tensioned reinforcing panel material;

moving said reinforcing panel material from work area to a storage area; and whereby, said reinforcing panel material will have either of weakened and separated fibers in said predetermined location prior to application to said hollow pressure cell.

57. An ovoid flexible pressure vessel as described in claim 9, further comprising a plastic overcoating.

* * * * *